US007252371B2

(12) United States Patent
Sugahara

(10) Patent No.: US 7,252,371 B2
(45) Date of Patent: Aug. 7, 2007

(54) LIQUID DELIVERING DEVICE

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 156 days.

(21) Appl. No.: 10/944,191

(22) Filed: Sep. 20, 2004

(65) Prior Publication Data

US 2005/0073557 A1 Apr. 7, 2005

(30) Foreign Application Priority Data

Sep. 26, 2003 (JP) ..... 2003-335165

(51) Int. Cl.
*B41J 2/045* (2006.01)

(52) U.S. Cl. ..... 347/68

(58) Field of Classification Search ..... 347/68, 347/69, 70–72

See application file for complete search history.

(56) References Cited

U.S. PATENT DOCUMENTS 5,581,861 A * 12/1996 Lee et al. ..... 29/25.35
2003/0081079 A1* 5/2003 Mitsuhashi et al. ..... 347/68

FOREIGN PATENT DOCUMENTS

JP A-58-108163 6/1983
JP 04099636 A * 3/1992

* cited by examiner

*Primary Examiner*—Matthew Luu
*Assistant Examiner*—Lisa M. Solomon
(74) *Attorney, Agent, or Firm*—Oliff & Berridge, PLC

(57) ABSTRACT

A liquid delivering device including: (a) a cavity unit defining pressure chambers; and (b) a piezoelectric actuator unit superposed on the cavity unit, and having active portions opposed to the respective pressure chambers and selectively deformable upon application of a drive voltage thereto so as to deliver a liquid from the corresponding pressure chambers to the exterior. The actuator unit includes first and second flexible layers, and a piezoelectric material layer interposed between the first and second flexible layers. A portion of the piezoelectric material layer located in a central region of each active portion is offset from a center of the piezoelectric actuator unit, as viewed in a thickness direction of the actuator unit, in one of a direction toward the cavity unit and a direction away from the cavity unit, while a portion of the piezoelectric material layer located in an outer region of each active portion is offset from the above-described center, as viewed in the thickness direction, in the other of the direction toward the cavity unit and the direction away from the cavity unit.

21 Claims, 17 Drawing Sheets

LIQUID DELIVERING DEVICE

This application is based on Japanese Patent Application No. 2003-335165 filed in Sep. 26, 2003, the content of which is incorporated hereinto by reference.

BACKGROUND OF THE INVENTION

1. Field of the Invention

The present invention relates in general to a liquid delivering device, and more particularly to such a liquid delivering device operable with activation of a piezoelectric material element.

2. Discussion of Related Art

There has been known an ejection device, as disclosed in JP-A-S58-108163, including (a) an oscillating plate which covers a plurality of pressure chambers storing a liquid, and (b) a plurality of piezoelectric elements which are superposed on the oscillating plate so as to oppose the respective pressure chambers and which constitute a plurality of active portions selectively activated. In this ejection device, for ejecting the ink delivered from a selected one of the pressure chambers, a corresponding one of the active portions is activated to oscillate or deform a corresponding portion of the oscillating plate, so as to change a pressure within the selected pressure chamber whereby the liquid in the form of a droplet is ejected through a corresponding nozzle which is held in communication with the selected pressure chamber. However, in this instance, not only the selected pressure chamber but also another pressure chamber adjacent to the selected pressure chamber tends to be influenced by the deformation of the oscillating plate, so that a pressure within the adjacent pressure chamber is likely to be somewhat fluctuated. Due to such a cross talk occurring between the adjacent pressure chambers, an amount of the ink delivered from each of the pressure chambers to the corresponding nozzle tends to be fluctuated rather than being constant, thereby making difficult to eject the droplet with a constant volume at a constant velocity.

SUMMARY OF THE INVENTION

The present invention was made in view of the background prior art discussed above. It is therefore an object of the invention to provide a liquid delivering device in which occurrence of the above-described problematic cross talk is reduced. This object may be achieved according to any one of first through third aspects of the invention which are described below.

The first aspect of the invention provides a liquid delivering device comprising: (a) a cavity unit defining a plurality of pressure chambers for accommodating a liquid which is to be delivered to an exterior of the liquid delivering device; and (b) a piezoelectric actuator unit superposed on the cavity unit, and having a plurality of active portions which are opposed to the respective pressure chambers and which are selectively deformable upon application of a drive voltage thereto so as to deliver the liquid from the corresponding pressure chambers to the exterior of the liquid delivering device. The piezoelectric actuator unit has a plate-like shape, and includes (b-1) a piezoelectric material layer which is deformable at least in a direction parallel thereto upon generation of an electric field therein as a result of the application of the drive voltage to the piezoelectric actuator unit, (b-2) a first flexible layer which is laminated on one of opposite side surfaces of the piezoelectric material layer, and (b-3) a second flexible layer which is laminated on the other of the opposite side surfaces of the piezoelectric material layer. A portion of the piezoelectric material layer located in a central region of each of the active portions is offset from a center of the piezoelectric actuator unit, as viewed in a thickness direction of the piezoelectric actuator unit, in one of a direction toward the cavity unit and a direction away from the cavity unit, while a portion of the piezoelectric material layer located in an outer region of each of the active portions is offset from the center of the piezoelectric actuator unit, as viewed in the thickness direction, in the other of the direction toward the cavity unit and the direction away from the cavity unit.

In the liquid delivering device constructed according to the first aspect of the invention, the portion of the piezoelectric material layer located in the central region of each active portion is offset from the center of the piezoelectric actuator unit, as viewed in the thickness direction of the plate-like piezoelectric actuator unit, in one of the direction toward the cavity unit and the direction away from the cavity unit, while the portion of the piezoelectric material layer located in the outer region of each of the active portions is offset from the center of the piezoelectric actuator unit, as viewed in the thickness direction, in the other of the direction toward the cavity unit and the direction away from the cavity unit. Owing to this construction, the central region and the outer region of each active portion of the actuator unit, upon application of the drive voltage to the active portion, can be deformed to be convexed in respective directions which are opposite to each other. Therefore, the deformations in the respective opposite directions are cancelled out by each other in the outer region, whereby occurrence of the cross talk can be reduced by the simple construction, thereby leading to an improvement in the delivery of the liquid by the device. It is noted that each of the above-described portions of the piezoelectric material layer located in the central region and outer region does not have to be necessarily offset in its entirety from the center of the piezoelectric actuator unit, as long as a center of each of the above-described portions is offset from the center of the piezoelectric actuator unit, as viewed in the thickness direction of the plate-like piezoelectric actuator unit. It is further noted that the piezoelectric material layer of the plate-like piezoelectric actuator unit may be bent in each of the active portions.

According to the second aspect of the invention, in the liquid delivering device in the first aspect of the invention, the first flexible layer has a small thickness in one of the central region and the outer region of each of the active portions, and a large thickness, which is larger than the small thickness, in the other of the central region and the outer region. The piezoelectric material layer interposed between the first and second flexible layers has a recess in the other of the opposite side surfaces thereof, such that the recess is located in the one of the central region and the outer region of each of the active portions, wherein the second flexible layer includes an embedded portion embedded in the recess which is located in the one of the central region and the outer region of each of the active portions. The central region and the outer region of each of the active portions of the piezoelectric actuator unit, upon application of the drive voltage to the each of the active portions, are deformed to be convexed in respective directions which are opposite to each other.

According to the third aspect of the invention, in the liquid delivering device in the first aspect of the invention, the first flexible layer has a through-hole formed therethrough, such that the through-hole is located in the central region of each of the active portions. The piezoelectric material layer interposed between the first and second flexible layers has a recess in the other of the opposite side surfaces thereof, such that the recess is located in the central region of each of the active portions. The second flexible layer has an embedded portion embedded in the recess which is located in the central region of each of the active portions, and the central region and the outer region of each of the active portions of the piezoelectric actuator unit, upon application of the drive voltage to the each of the active portions, are deformed to be convexed in respective directions which are opposite to each other.

In the liquid delivering device constructed according to the second or third aspect of the invention, the second flexible layer includes the embedded portion embedded in the recess which is located in each of the active portions. This arrangement enables the liquid delivery device to be made compact in size so as to be easily installed in an apparatus such as an inkjet print head and a micro pump.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
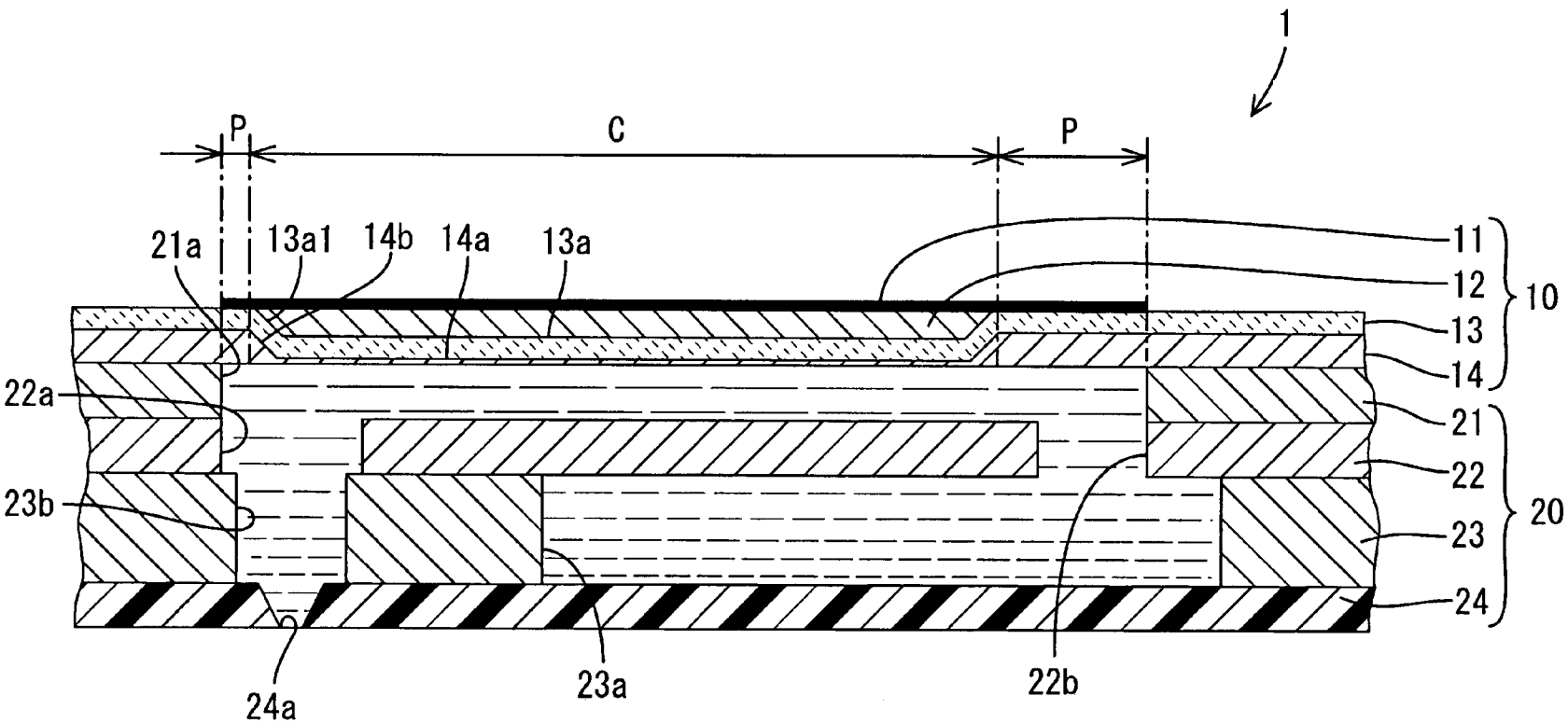
FIG. 1 is a cross sectional view of a liquid delivering device constructed according to a first embodiment of the invention, taken along a line parallel with a longitudinal direction of pressure chambers of the device.

Referring first to FIGS. 1-5, there will be described a liquid delivering device 1 constructed according to a first embodiment of the invention. In the following description, It is noted that the left half of FIG. 3 corresponds to a plan view of the liquid delivering device 1 and that the right half of FIG. 3 corresponds to a cross sectional view of the device 1 taken in a plane having the same height as pressure chambers 21*a*.

The liquid delivering device 1 includes a cavity unit in the form of a passage defining unit 20, and a piezoelectric actuator unit 10 which has a plate-like shape as a whole and which is fixedly superposed on the passage defining unit 20. The passage defining unit 20 has a plurality of pressure chambers 21*a* for accommodating a liquid which is to be eventually ejected from the device 1. The pressure chambers 21*a* open in an upper surface of the passage defining unit 20, and the openings of the respective pressure chambers 21*a* are closed by the piezoelectric actuator unit 10 which is superposed on the passage defining unit 20. The passage defining unit 20 is a laminar structure including: a nozzle plate 24 having a plurality of nozzles 24*a* formed therethrough; a manifold plate 23 superposed on the nozzle plate 24; a passage plate 22 superposed on the manifold plate 23; and a pressure-chamber plate 21 superposed on the passage plate 22. The plates 21-24 are provided by substantially flat plates, and are fixed to each other by a thermosetting adhesive such as an epoxy bond.

Each of the plates 21-23 is made of a metallic material such as stainless steel. The pressure-chamber plate 21 defines the plurality of pressure chambers 21*a*, each of which is held in communication at its opposite end portions with a pressure passage 22*a* and a manifold passage 22*b* that are defined by the passage plate 22. The manifold plate 23 defines a manifold chamber 23*a* which is held in communication with a liquid tank (not shown), and nozzle passages 23*b* each of which is contiguous to the corresponding pressure passage 22*a*.

The nozzle plate 24 is made of polyimide-based synthetic resin material, and defines the plurality of nozzles 24*a* each of which is contiguous to the corresponding nozzle passage 23*b*, as shown in FIG. 1. The liquid stored in the liquid tank is supplied to the nozzles 24*a* via the manifold chamber 23*a*, manifold passages 22*b*, pressure chambers 21*a*, pressure passages 22*a* and nozzle passages 23*b*.

Figure 3:
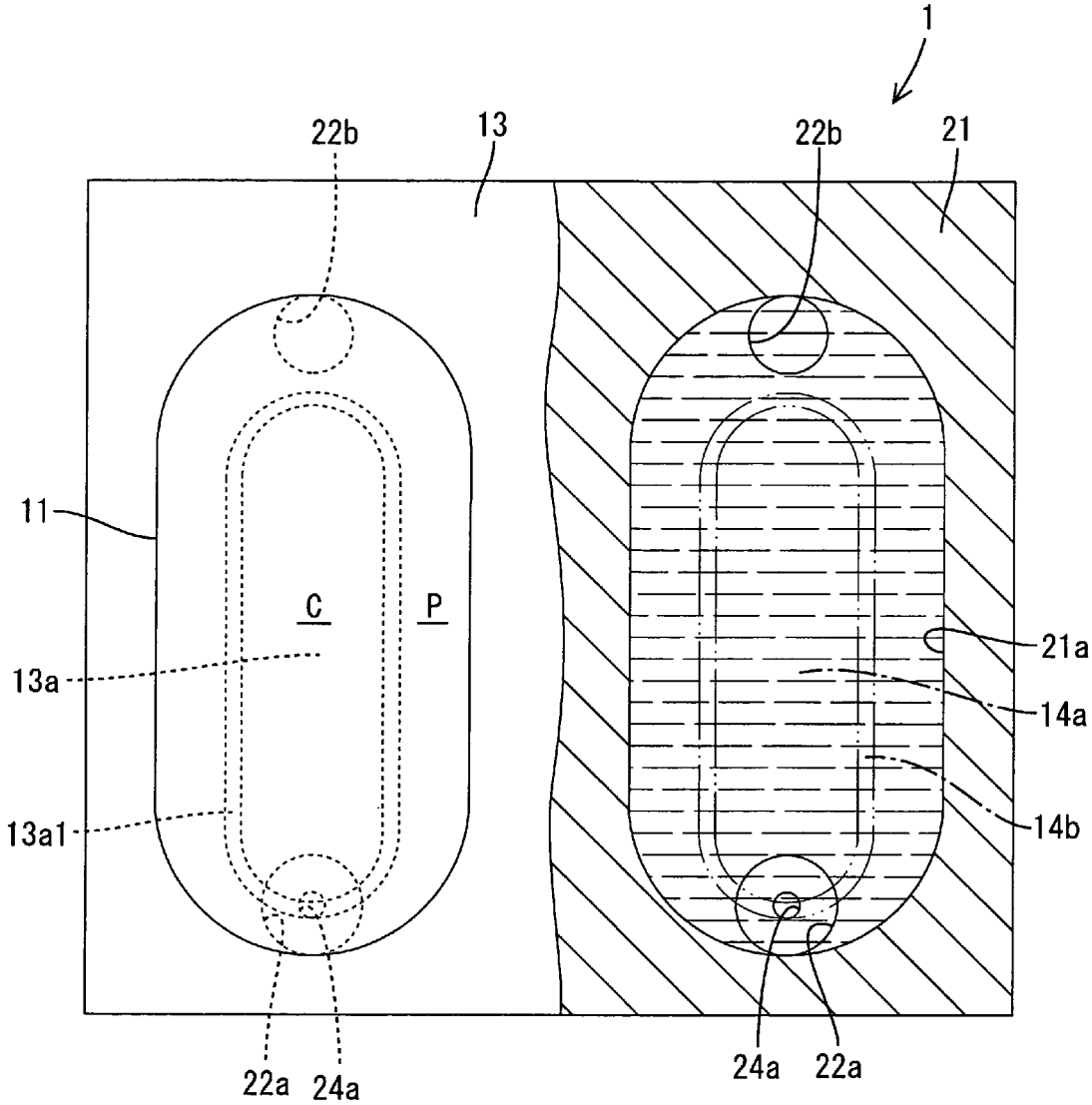
FIG. 3 is a plan view partially in cross section of the liquid delivering device of FIG. 2.
Figure 5:
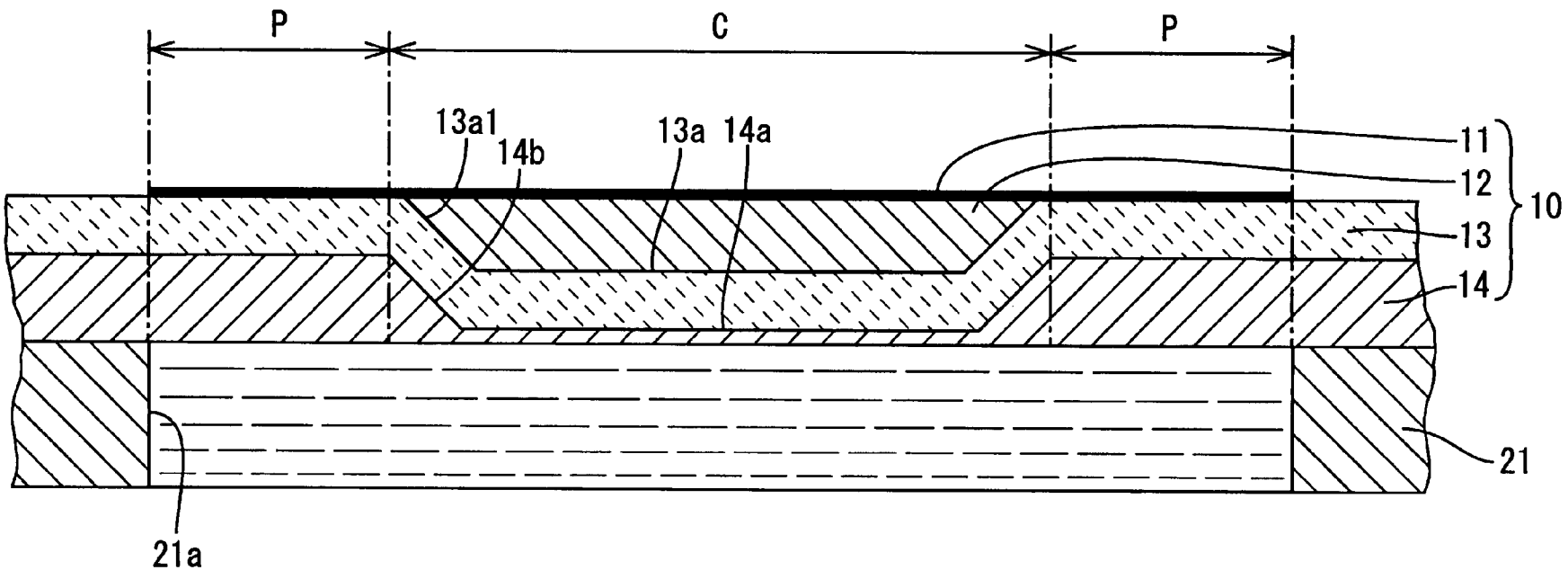
FIG. 5 is a cross sectional view showing in enlargement a main part of the liquid delivering device of FIG. 2.

The piezoelectric actuator unit 10 has a plurality of active portions which are aligned with or opposed to the respective pressure chambers 21*a* and which are selectively deformable upon application of a drive voltage thereto so as to deliver the liquid from the corresponding pressure chambers 21*a* to the exterior of the liquid delivering device 1. As shown in FIG. 5, the actuator unit 10 is provided by a laminar structure, and includes a first flexible layer in the form of an oscillating plate 14 which is provided by a generally flat plate made of a conductive metallic material such as stainless steel. In the present embodiment, the oscillating plate 14, which defines upper ends of the respective pressure chambers 21*a*, is used as a lower electrode which is grounded and constitutes a part of a drive circuit (not shown). The oscillating plate 14 of the actuator unit 10 has a plurality of thin-walled portions 14*a* each located in a central region C of the corresponding active portion which is opposed to the corresponding pressure chamber 21*a*. In each of the thin-walled portions 14*a*, the oscillating plate 14 is recessed at its upper surface (i.e., its surface remote from the pressure chambers 21*a*), for example, by machining or etching. Thus, the oscillating plate 14 has a relatively small thickness in the central region C of each active portion, and a relatively large thickness in an outer region P of each active portion, which surrounds the central region C to have an annular shape. Namely, the upper surface of the oscillating plate 14 is made lower in the thin-walled portions 14*a* than in the other portion of the oscillating plate 14. Each of the thin-walled portions 14*a*, similar to each of the pressure chambers 21*a*, has a generally oval shape in the plan view as shown in FIG. 3, and has a cross sectional area smaller than that of each pressure chamber 21*a*, as is apparent from FIG. 3. It is noted that each thin-walled portion 14*a* is connected to the other portion via a slant surface 14*b* which surrounds each thin-walled portion 14*a*.

The piezoelectric actuator unit 10 provided by the laminar structure further includes a single piezoelectric material layer 13 which is superposed on and fixed to the upper surface of the oscillating plate 14 (i.e., one of opposite side surfaces of the oscillating plate 14 that is remote from the pressure chambers 21*a*). The piezoelectric material layer 13 is provided by a layer having a constant thickness, so that its upper surface is made lower in its portions located right above the thin-walled portions 14*a* of the oscillating plate 14, than in the other portion of the layer 13. Thus, the piezoelectric material layer 13 is bent to have recesses 13*a* formed in its upper surface, i.e., in one of its opposite side surfaces that is remote from the pressure chambers 21*a*, such that the recesses 13*a* are located in the central regions C of the respective active portions of actuator unit 10. It is noted that the piezoelectric material layer 13 is made of lead zirconium titanate (PZT) in the present embodiment. However, the piezoelectric material layer 13 may be made of other piezoelectric material such as barium titanate, lead titanate and Rochelle salt.

Each of the recesses 13*a* is connected to the other portion of the piezoelectric material layer 13 via a slant surface 13*a*1 which surrounds each recess 13*a*. Thus, a portion of the piezoelectric material layer 13 located in the central region C of each active portion is given a cup-like shape. The piezoelectric material layer 13 may be formed on the oscillating plate 14 by either aerosol deposition (AD) method, sputtering, or sol-gel method which includes a piezoelectric-layer forming step of forming the layer by heating a solution applied to the oscillating plate 14. Further, alternatively, the piezoelectric material layer 13 is provided by a layer, which is fixed to the oscillating plate 14 by a conductive adhesive after the layer has been formed to have a predetermined shape.

The piezoelectric actuator unit 10 further includes a second flexible layer in the form of a filler layer 12, which is embedded in each of the recesses 13*a* of the piezoelectric material layer 13 so as to be fixed to the upper surface of the piezoelectric material layer 13. This filler layer 12 is made of a conductive metallic material such as stainless steel, nickel, chromium, copper and aluminum. Where the filler layer 12 is made of stainless steel, the filler layer 12 is formed to have a shape conforming to a shape of the recess 13*a* and is then fixed into the recess 13*a* by a conductive adhesive. Where the filler layer 12 is made of nickel, chromium, copper or aluminum, the filler layer 12 may be fixed into the recess 13*a* by either a conductive adhesive or an aerosol deposition method after being formed to have the shape conforming to the shape of the recess 13*a*. Further, in the latter case, the filler layer 12 may be formed in the recess 13*a* by electroforming, plating, vapor-deposition or sputtering.

The filler layer 12 may be made of the same material as the oscillating plate 14, so as to have the same coefficient of thermal expansion as the oscillating plate 14, thereby making it possible to advantageously minimize a stress acting on the piezoelectric material layer 13 (which is sandwiched between the filler layer 12 and the oscillating plate 14) even under a condition with considerable variation in temperature. This technical advantage can be obtained, even where the filler layer 12 and the oscillating plate 14 are made of respective materials different from each other as long as the respective materials have the same coefficient of thermal expansion. It is noted that the filler layer 12 is given a rigidity higher than that of the thin-walled portion 14*a* of the oscillating plate 14, irrespective of kinds of materials selected to form the filler layer 12 and the oscillating plate 14.

The piezoelectric material layer 13, generally interposed between the filler layer 12 and the oscillating plate 14, includes a non-interposed portion which is located in the outer region P of each of active portion and which has an upper surface contiguous with or substantially flush with an upper surface of the filler layer 12. On the upper surfaces of the filler layer 12 and the non-interposed portion of the piezoelectric material layer 13, there is disposed an upper electrode 11 which is electrically connected to a positive terminal of an electric source of the drive circuit via a switching element (not shown). The upper electrode 11 is provided by a thin conductive film which is bonded to or printed on the filler layer 12 and the piezoelectric material layer 13. The upper electrode 11 cooperates with the above-described filler layer 12, piezoelectric material layer 13 and oscillating plate 14 to constitute the piezoelectric actuator unit 10.

Owing to the construction as described above, a portion of the piezoelectric material layer 13 located in the central region C of each active portion is offset from a center of the actuator unit 10 in a direction toward the passage-defining unit 20 as viewed in a thickness direction of the actuator unit 10, while the non-interposed portion of the piezoelectric material layer 13 (i.e., a portion of the piezoelectric material layer 13 located in the outer region P of each active portion) is offset from the center of the actuator unit 10 in a direction away from the passage-defining unit 20 as viewed in the thickness direction of the actuator unit 10.

Figure 2:
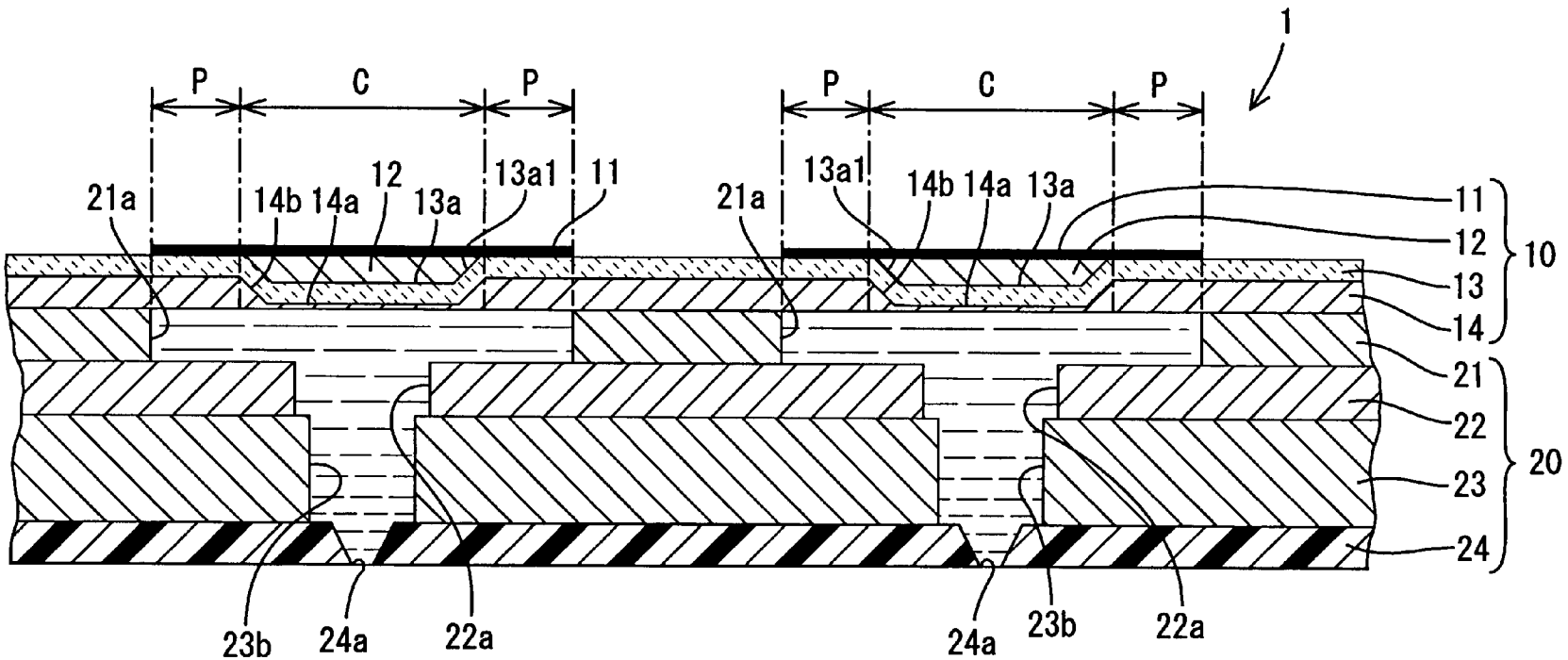
FIG. 2 is a cross sectional view of the liquid delivering device of FIG. 1, taken along a line parallel with a row in which the pressure chambers are arranged.

In the liquid delivering device 1 of the present embodiment, while the device 1 is not required to eject droplets through the nozzles 24*a*, a drive voltage is not applied between the electrodes so that the piezoelectric actuator unit 10 remains undeformed, as shown in FIG. 2. When it is required to eject the droplets through each nozzle 24*a*, the corresponding switching element is turned ON whereby the drive voltage is applied between the corresponding upper electrode 11 and the lower electrode which is provided by the oscillating plate 14. As a result of the application of the drive voltage between the corresponding upper electrode 11 and the oscillating plate 14, an electric field is generated in a portion of the piezoelectric material layer 13 which constitutes a part of the corresponding active portion of the actuator unit 10, so that this portion of the piezoelectric material layer 13 expands in its thickness direction (i.e., in the vertical direction as seen in FIG. 2) and contracts in its surface direction (i.e., in a direction parallel thereto or in the horizontal direction as seen in FIGS. 1 and 2).

Figure 4:
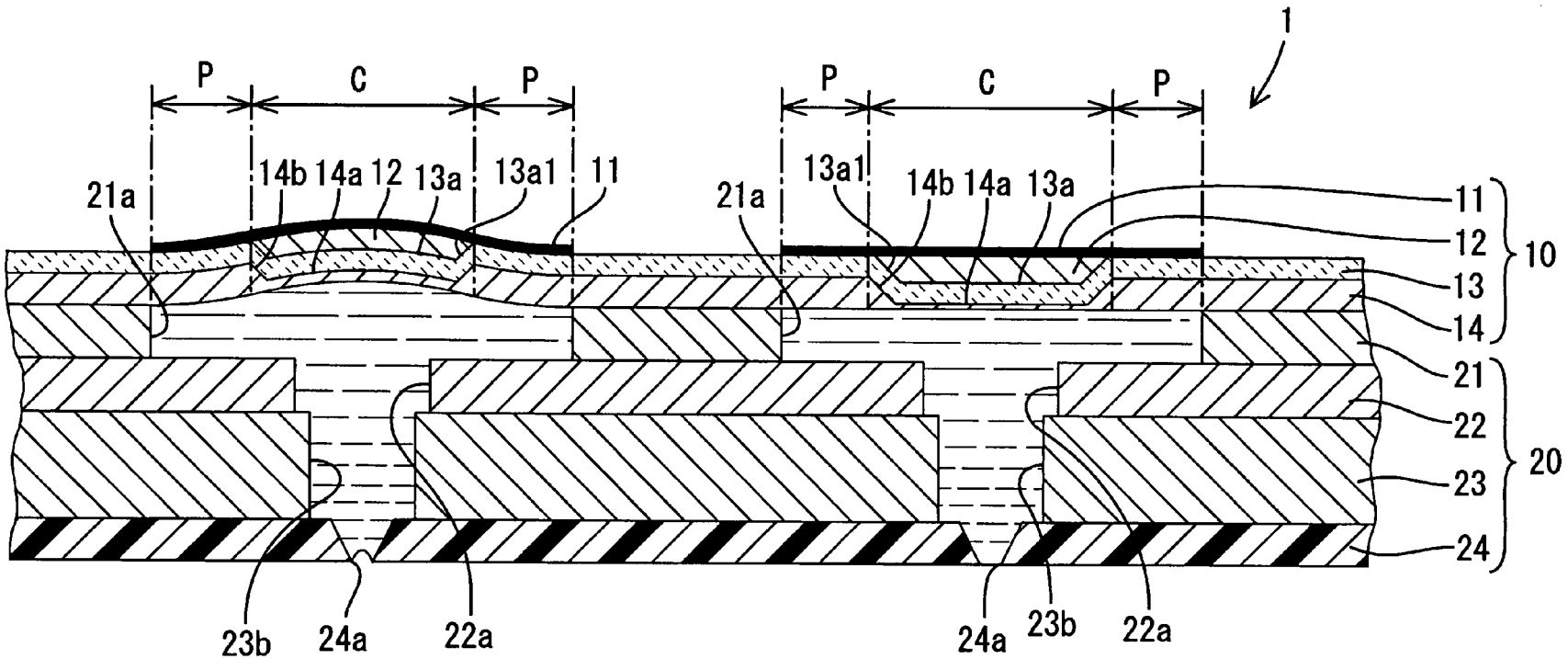
FIG. 4 is a cross sectional view of the liquid delivering device of FIG. 2, showing its operating state.

In this instance, as a result of the contraction of the above-described portion of the piezoelectric material layer 13 in the surface direction, the central region C of the corresponding active portion of the actuator unit 10 is deformed to be convexed in a direction away from the pressure chamber 21*a* (i.e., in the upward direction as seen in FIG. 4) as shown in the left-side part of FIG. 4, since the recess 13*a* located in the central region C is filled with the filler layer 12 whose rigidity is higher than that of the thin-walled portion 14*a* of the oscillating plate 14. On the other hand, the outer region P of the corresponding active portion of the actuator unit 10 is deformed to be convexed in a direction toward the pressure chamber 21*a* (i.e., in the downward direction as seen in FIG. 4), since the above-described other portion (i.e., non-thin-walled portion) of the oscillating plate 14 having a certain degree of rigidity underlies the piezoelectric material layer 13 in the outer region P.

With the deformation of the central region C of the active portion of the piezoelectric actuator unit 10 in the direction away from the pressure chamber 21*a*, a pressure in the pressure chamber 21*a* is reduced as a result of increase in a volume of the pressure chamber 21*a*, and the pressure chamber 21*a* is then refilled with the liquid which is delivered thereto from the liquid tank via the manifold chamber 23*a* and the manifold passage 22*b*.

When the switching element is turned OFF after the supply of the liquid to the pressure chamber 21*a*, the above-described portion of the piezoelectric material layer 13 (which has contracted in its surface direction) restores its original undeformed shape as a result of suspension of the application of the drive voltage between the electrodes, whereby the active portion of the piezoelectric actuator unit 10 returns to its original position, as shown in FIG. 2. With the return of the active portion of the piezoelectric actuator unit 10 to its original position, the pressure in the pressure chamber 21*a* is increased as a result of reduction in the volume of the pressure chamber 21*a*, whereby the ink is delivered from the pressure chamber 21*a* to the nozzle 24*a* via the pressure passage 22*a* and the nozzle passage 23*b*, and the ink in the form of droplets is then ejected through the nozzle 24*a*.

Figure 6:
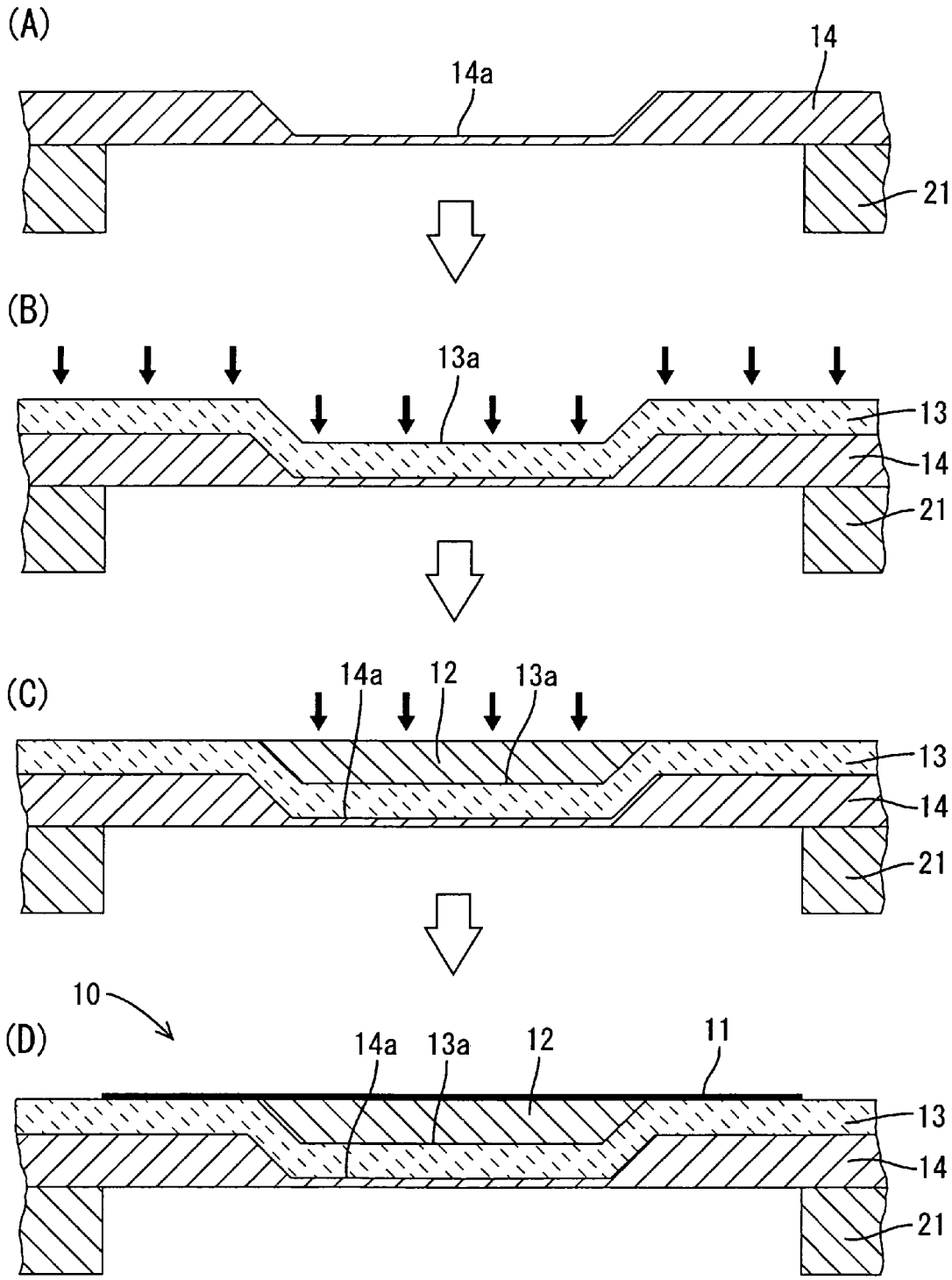
FIG. 6 is a set of views showing a process of manufacturing a piezoelectric actuator unit of the device of FIG. 2, wherein (A) is a view illustrating a step of fixing an oscillating plate onto a pressure-chamber plate, (B) is a view illustrating a step of fixing a piezoelectric material layer onto the oscillating plate, (C) is a view illustrating a step of fixing a filler layer into a recess of the piezoelectric material layer, and (D) is a view illustrating a step of forming an upper electrode on the piezoelectric material layer and the filler layer.

FIG. 6 is a set of views showing a process of manufacturing the piezoelectric actuator unit 10. The manufacturing process is initiated with a step (A) of fixing the oscillating plate 14 onto the pressure-chamber plate 21. In this step (A), the oscillating plate 14 (made of a stainless steel and having the thin-walled portion 14*a* that is previously formed by machining or etching) is bonded to the pressure-chamber plate 21 by an adhesive. The step (A) is followed by a step (B) of fixing the piezoelectric material layer 13 onto the oscillating plate 14. In this step (B), the piezoelectric material layer 13 is formed on the oscillating plate 14 by aerosol deposition method, sol-gel method or sputtering, such that the piezoelectric material layer 13 is given the recess 13*a* which is located right above the thin-walled portion 14*a* of the oscillating plate 14. However, the piezoelectric material layer 13 may be provided by a piezoelectric member which is shaped to have the recess 13*a* before it is fired, and which is then fixed to the oscillating plate 14 by a conductive adhesive after it is fired.

The step (B) is followed by a step (C) of fixing the filler layer 12 into the recess 13*a* of the piezoelectric material layer 13. In this step (C), the recess 13*a* of the piezoelectric material layer 13 is filled with nickel in accordance with aerosol deposition method, whereby the filler layer 12 is embedded in the recess 13*a*. However, the filler layer 12 may be formed in the recess 13*a* by electroforming, plating, vapor-deposition or sputtering. Further, alternatively, the filler layer 12 may be provided by a member which is previously shaped to be fitted in the recess 13*a* and which is posteriorly fixed in the recess 13*a* by a conductive adhesive. The process of manufacturing the piezoelectric actuator unit 10 is completed with implementation of a step (D) in which the upper electrode 11 provided by a thin conductive film is bonded to or printed on the upper surfaces of the filler layer 12 and the piezoelectric material layer 13.

In the liquid delivering device 1 of the present embodiment, upon application of the drive voltage to each active portion of the piezoelectric actuator unit 10, the central region C of each active portion is deformed to be convexed in the direction away from the corresponding pressure chamber 21*a* while the outer region P of each active portion is deformed to be convexed in the direction toward the corresponding pressure chamber 21*a*, as described above. Therefore, the deformations in the respective opposite directions are cancelled out by each other in the outer region P, thereby making it possible to reduce occurrence of a so-called cross talk, i.e., a phenomenon that not only the selected pressure chamber 21*a* (whose volume is to be changed) but also the other pressure chambers 21*a* adjacent to the selected pressure chamber 21*a* are influenced by the deformation of the oscillating plate 14. The reduction in occurrence of the problematic cross talk leads to an improvement in the delivery of the liquid by the device 1. Further, since the portion of the oscillating plate 14 which corresponds to the central region C of each active portion of the actuator unit 10 is provided by the thin-walled portion 14*a*, this portion of the oscillating plate 14 is given a relatively low rigidity and is accordingly capable of being deflected or deformed by a large amount. Still further, since the filler layer 12 as the second flexible layer is embedded in the recess 13*a* of the piezoelectric material layer 13, the liquid delivery device 1 can be made compact in size so as to be easily installed in an apparatus such as an inkjet print head and a micro pump.

Further, in the liquid delivering device 1, upon application of the drive voltage to each active portion of the piezoelectric actuator unit 10, the central region C of each active portion is deformed to be convexed in the direction away from the corresponding pressure chamber 21*a*, namely, in such a direction that increases the volume of the pressure chamber 21*a*. This arrangement advantageously eliminates necessity of normally generating an electric field across the piezoelectric material layer 13 even where the device 1 is arranged to eject the ink from the pressure chamber 21*a* by a so-called "fill-before-fire" action, namely, to eject the ink by rapidly deflecting the oscillating plate 14 toward the pressure chamber 21*a* after once deflecting the plate 14 away from the pressure chamber 21*a*. The elimination of the necessity of normal generation of the electric field improves durability of the piezoelectric material layer 13 or the electrode 11.

Further, in the liquid delivering device 1, the filler layer 12 is made of a conductive metallic material, and the upper electrode 11 is disposed on the upper surfaces of the filler layer 12 and the non-interposed portion of the piezoelectric material layer 13. Since the upper electrode 11 is thus disposed to be exposed, it can be easily incorporated into the actuator unit 10. In addition, where the filler layer 12 is formed on the piezoelectric material layer 13 in accordance with aerosol deposition method, the formation can be made in a short length of time. Further, where the filler layer 12 is formed on the piezoelectric material layer 13 by electroforming, plating, vapor-deposition or sputtering, the filler layer 12 can be easily made to have a constant thickness.

Further, where the oscillating plate 14 is made of a conductive material and is fixed to the piezoelectric material layer 13 by a conductive adhesive, the oscillating plate 14 can serve as the lower electrode which cooperates with the upper electrode 11 for generating the electric field across the piezoelectric material layer 13. This arrangement eliminates necessity of provision of a member serving exclusively as the lower electrode, thereby reducing the manufacturing cost. In addition, where the piezoelectric material layer 13 is formed on the oscillating plate 14 in accordance with aerosol deposition method, the formation can be made in a short length of time. Further, where the piezoelectric material layer 13 is formed on the oscillating plate 14 by sputtering or sol-gel method, the piezoelectric material layer 13 can be easily made to have a constant thickness.

Figure 7:
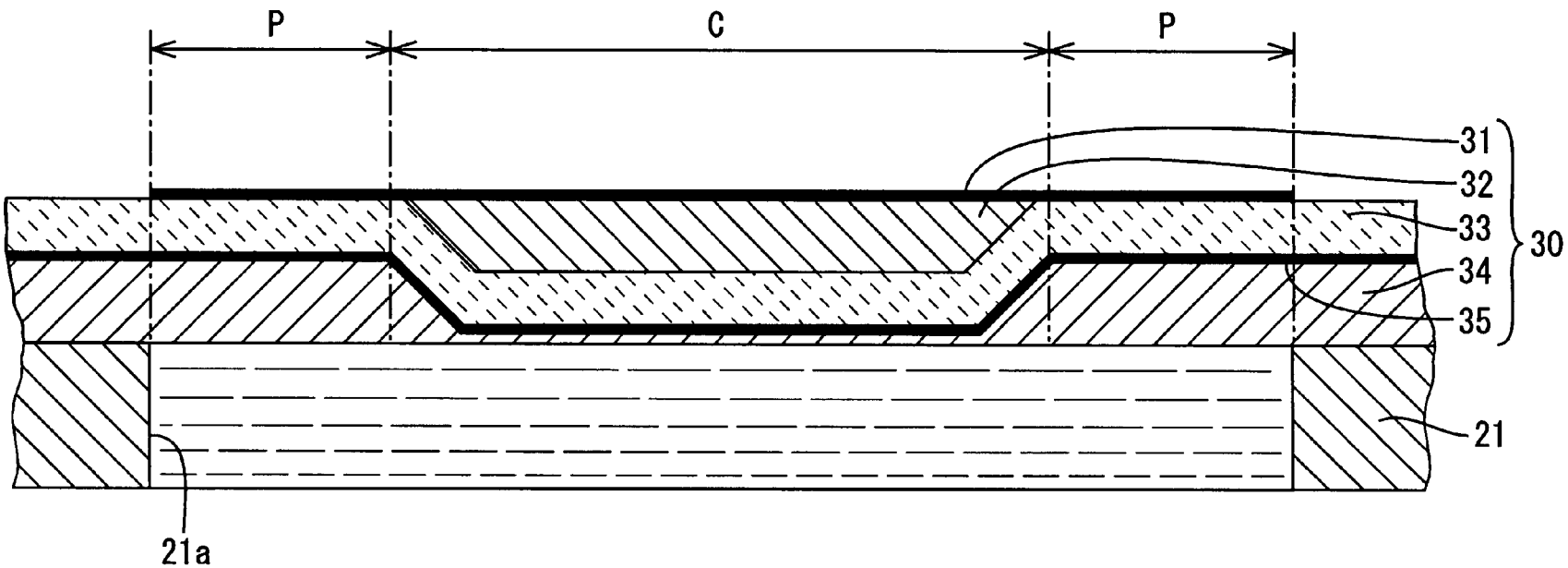
FIG. 7 is a cross sectional view showing in enlargement a main part of a liquid delivering device constructed according to a modification of the first embodiment of the invention.

FIG. 7 shows a piezoelectric actuator unit 30 as a modification of the above-described piezoelectric actuator unit 10 of the first embodiment. This piezoelectric actuator unit 30 includes an upper electrode 31, a filler layer 32, a piezoelectric material layer 33, an oscillating plate 34 and a lower electrode 35, and is different from the piezoelectric actuator unit 10 in that the lower electrode 35 is interposed between the piezoelectric material layer 33 and the oscillating plate 34. Like the upper electrode 11 of the actuator unit 10, the lower electrode 35 is provided by a thin conductive film which is bonded to or printed on the oscillating plate 34, and the piezoelectric material layer 33 is then fixed onto the lower electrode 35 by aerosol deposition method, conductive adhesive, sol-gel method or sputtering method. It is noted that the upper electrode 31, filler layer 32, piezoelectric material layer 33 and oscillating plate 34 in this modification are identical with those in the first embodiment, and that redundant description of these elements is not provided.

In this modification, the lower electrode 35 is provided between the piezoelectric material layer 33*a* and the oscillating plate 34, without the lower electrode 35 being exposed to the exterior. Therefore, the lower electrode 35 is protected against damaging or deterioration which could be caused if the electrode 35 were in contact with the liquid accommodated in the pressure chamber 21*a*. Further, since the oscillating plate 34 does not have to be made of a conductive material but may be made of any material, it is possible to reduce the cost of manufacture of the actuator unit 30.

In the above-described piezoelectric actuator units 10, 30, the filler layer 12 or 32 is disposed on one of opposite sides of the piezoelectric material layer 13 or 33 that is remote from the pressure chamber 21*a*. However, the filler layer 12 or 32 may be disposed on the other side of the piezoelectric material layer 13 or 33 that is close to the pressure chamber 21*a*, so that the central region C of each active portion is deformed to be convexed in the direction toward the pressure chamber 21*a*, upon application of the drive voltage to the actuator unit 10 or 30. Further, while the thin-walled portion of the oscillating plate 14 or 34 and the recess of the piezoelectric material layer 13 or 33 are positioned in the central region C of each active portion in the above-described piezoelectric actuator units 10, 30, the thin-walled portion and the recess may be positioned in the outer region P which surrounds the central region C, so that the central region C of each active portion is deformed to be convexed in the direction toward the pressure chamber 21*a*.

Figure 8:
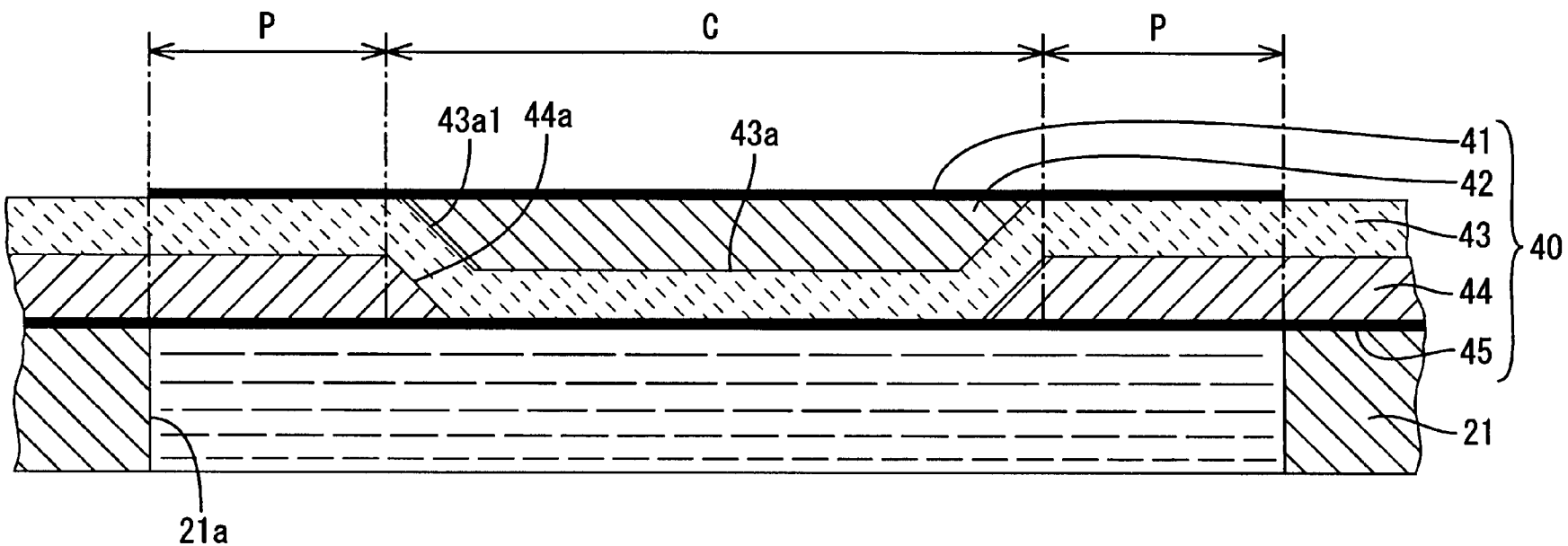
FIG. 8 is a cross sectional view showing in enlargement a main part of a liquid delivering device constructed according to a second embodiment of the invention.

Referring next to FIG. 8, there will be described a second embodiment of the invention. In this second embodiment, the liquid delivering device 1 is equipped with a piezoelectric actuator unit 40 which includes an upper electrode 41, a filler layer 42, a piezoelectric material layer 43, an oscillating plate 44 and a lower electrode 45. The oscillating plate 44 is provided by a generally flat plate made of a conductive metallic material such as stainless steel, and has a through-hole 44*a* formed therethrough such that the through-hole 44*a* is located in the central region C of each active portion of the actuator unit 40. The formation of the through-hole 44*a* is made by machining or etching. It is noted that the through-hole 44*a* is defined by a tapered or slant surface such that its cross sectional area decreases as viewed in the downward direction, as shown in FIG. 8.

The piezoelectric material layer 43 includes a non-interposed portion which is located inside the through-hole 44*a* and which has a lower surface contiguous with or substantially flush with a lower surface of the oscillating plate 44 (which surface is located in the outer region P of each active portion and is one of opposite side surfaces that is remote from the piezoelectric material layer 43). On the above-described lower surfaces of the non-interposed portion of piezoelectric material layer 43 and the oscillating plate 44, there is disposed the lower electrode 45 which is grounded and constitutes a part of the drive circuit. The lower electrode 45 is provided by a thin conductive film, like the upper electrode 11 of the first embodiment, and is bonded to or printed on the oscillating plate 44 and the piezoelectric material layer 43. In the piezoelectric actuator unit 40 of this second embodiment, therefore, the lower electrode 45 constitutes a lowermost portion of the actuator unit 40 so as to be contiguous with the pressure-chamber plate 21 and the pressure chamber 21*a*.

Like in the first embodiment, the piezoelectric material layer 43 is fixedly superposed on the upper surface of the oscillating plate 44. The piezoelectric material layer 43 is provided by a layer having a constant thickness, so that its upper surface is made lower in its portions located inside the through-holes 44*a* of the oscillating plate 44, than in the other portion of the layer 43. Thus, the piezoelectric material layer 43 is bent to have recesses 43*a* formed in its upper surface, i.e., in one of its opposite side surfaces that is remote from the pressure chambers 21*a*, such that the recesses 43*a* are located in the central regions C of the respective active portions of actuator unit 40. Each of the recesses 43*a* is connected to the other portion of the piezoelectric material layer 43 via a slant surface 43*a*1 which surrounds each recess 43*a*. Thus, a portion of the piezoelectric material layer 43 located in the central region C of each active portion is given a cup-like shape. The piezoelectric material layer 43 may be formed on the oscillating plate 44 by either aerosol deposition method, sputtering or sol-gel method, or alternatively, may be provided by a layer, which is fixed to the oscillating plate 44 by a conductive adhesive after the layer has been formed to have a predetermined shape.

In each recess 43*a* formed in the surface of the piezoelectric material layer 43 which surface is remote from the oscillating plate 44, there is embedded the filler layer 42 which is made of a conductive metallic material such as stainless steel, nickel, chromium, copper and aluminum, as in the first embodiment. On the upper surfaces of the filler layer 42 and the non-interposed portion of the piezoelectric material layer 43 (which portion is located in the outer region P of the active portion), there is provided the upper electrode 41 which is equivalent to the upper electrode 11 of the first embodiment. This upper electrode 41 is provided by a thin conductive film which is bonded to or printed on the filler layer 42 and the piezoelectric material layer 43, and is electrically connected to a positive terminal of an electric source of the drive circuit via a switching element.

Where the filler layer 42 is made of stainless steel, the filler layer 42 is formed to have a shape conforming to a shape of the recess 43*a* and is then fixed into the recess 43*a* by a conductive adhesive. Where the filler layer 42 is made of nickel, chromium, copper or aluminum, the filler layer 42 may be fixed into the recess 43*a* by either a conductive adhesive or an aerosol deposition method after, being formed to have the shape conforming to the shape of the recess 43*a*. Further, in the latter case, the filler layer 42 may be formed in the recess 43*a* by electroforming, plating, vapor-deposition or sputtering. Further, the filler layer 42 may be made of the same material as the oscillating plate 44, so as to have the same coefficient of thermal expansion as the oscillating plate 44, thereby making it possible to advantageously minimize a stress acting on the piezoelectric material layer 43 (which is sandwiched between the filler layer 42 and the oscillating plate 44) even under a condition with considerable variation in temperature. This technical advantage can be obtained, even where the filler layer 42 and the oscillating plate 44 are made of respective materials different from each other as long as the respective materials have the same coefficient of thermal expansion.

Owing to the construction as described above, the portion of the piezoelectric material layer 43 located in the central region C of each active portion is offset from a center of the actuator unit 40 in a direction toward the passage-defining unit 20 as viewed in a thickness direction of the actuator unit 40, while the portion of the piezoelectric material layer 43 located in the outer region P of each active portion is offset from the center of the actuator unit 40 in a direction away from the passage-defining unit 20 as viewed in the thickness direction of the actuator unit 40. With application of the drive voltage between the upper and lower electrodes 41 and 45 by placing the switching element in its ON state, the central region C of the active portion of the actuator unit 40 is deformed to be convexed in a direction away from the pressure chamber 21*a*, owing to the presence of the filler layer 42 embedded in the recess 43*a* which is located in the central region C. On the other hand, the outer region P of the active portion of the actuator unit 40 is deformed to be convexed in a direction toward the pressure chamber 21*a*, owing to the presence of the oscillating plate 44 underlying the piezoelectric material layer 43 in the outer region P. Since the piezoelectric actuator unit 40 is activated or operated in the same manner as in the first embodiment, redundant description of the operation of the actuator unit 40 is not provided.

In this second embodiment, too, the central region C of each active portion is deformed to be convexed in the direction away from the corresponding pressure chamber 21*a* while the outer region P of each active portion is deformed to be convexed in the direction toward the corresponding pressure chamber 21*a*, as described above. Therefore, the deformations in the respective opposite directions are cancelled out by each other in the outer region P, thereby making it possible to reduce occurrence of the problematic cross talk. The reduction in occurrence of the problematic cross talk leads to an improvement in the delivery of the liquid by the device 1. Further since the portion of the oscillating plate 44 which corresponds to the central region C of each active portion of the actuator unit 40 has the through-hole 44*a*, this portion of the oscillating plate 44 is given a relatively low rigidity and is accordingly capable of being deflected or deformed by a large amount. Still further, since the filler layer 42 as the second flexible layer is embedded in the recess 43*a* of the piezoelectric material layer 43, the liquid delivery device 1 can be made compact in size so as to be easily installed in an apparatus such as an inkjet print head and a micro pump.

Further, in the liquid delivering device 1, upon application of the drive voltage to each active portion of the piezoelectric actuator unit 40, the central region C of each active portion is deformed to be convexed in the direction away from the corresponding pressure chamber 21*a*, namely, in such a direction that increases the volume of the pressure chamber 21*a*. This arrangement advantageously eliminates necessity of normally generating an electric field across the piezoelectric material layer 43 even where the device 1 is arranged to eject the ink from the pressure chamber 21*a* by a so-called "fill-before-fire" action, namely, to eject the ink by rapidly deflecting the oscillating plate 44 toward the pressure chamber 21*a* after once deflecting the plate 44 away from the pressure chamber 21*a*. The elimination of the necessity of normal generation of the electric field improves durability of the piezoelectric material layer 43 or the electrode 41.

Further, in the liquid delivering device 1, the oscillating plate 44 is made of a conductive metallic material, and the lower electrode 45 is disposed on the lower surfaces of the oscillating plate 44 and the non-interposed portion of the piezoelectric material layer 43 (which portion is located inside the through-hole 44*a*). Thus, the lower electrode 45 constitutes a lowermost portion of the actuator unit 40 so as to be contiguous with the pressure-chamber plate 21 and the pressure chamber 21*a*, without the lower electrode 45 being exposed to the exterior. Therefore, the lower electrode 45 is protected against damaging which could be caused if they are brought into contact with an operator or a foreign object, for example, while the liquid delivering device 1 is being transferred. Further, in this second embodiment in which the lower electrode 45 underlies the non-interposed portion of the piezoelectric material layer 43 (which portion is located inside the through-hole 44*a*) and the oscillating plate 44, the lower electrode 45 can be easily attached to the piezoelectric material layer 43 and the oscillating plate 44, since the lower surface of the non-interposed portion of the piezoelectric material layer 43 and the lower surface of the oscillating plate 44 are substantially flush with each other so as to cooperate to provide a flat surface.

In addition, where the piezoelectric material layer 43 is formed on the oscillating plate 44 in accordance with aerosol deposition method, the formation can be made in a short length of time. Where the piezoelectric material layer 43 is formed on the oscillating plate 44 by sputtering or sol-gel method, the piezoelectric material layer 43 can be easily made to have a constant thickness. Further, where the filler layer 42 is formed on the piezoelectric material layer 43 in accordance with aerosol deposition method, the formation can be made in a short length of time. Where the filler layer 42 is formed on the piezoelectric material layer 43 by electroforming, plating, vapor-deposition or sputtering, the filler layer 42 can be easily made to have a constant thickness.

Figure 9:
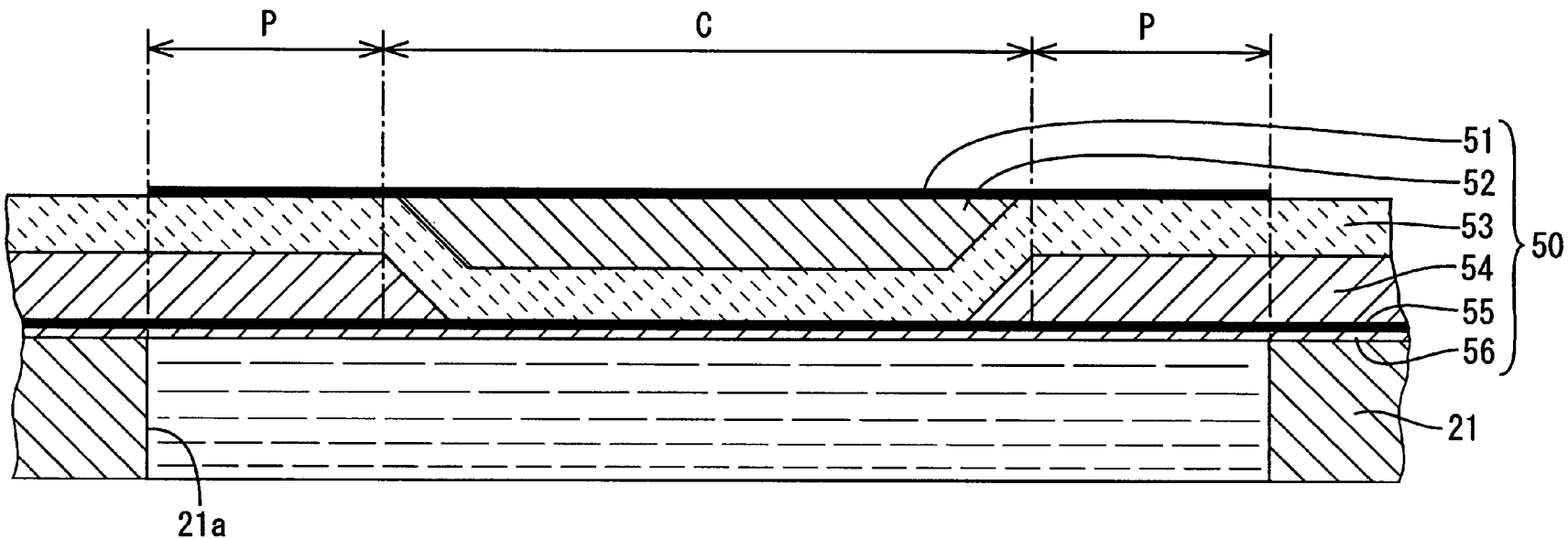
FIG. 9 is a cross sectional view showing in enlargement a main part of a liquid delivering device constructed according to a first modification of the second embodiment of the invention.

FIG. 9 shows a piezoelectric actuator unit 50 as a first modification of the above-described piezoelectric actuator unit 40 of the second embodiment. This piezoelectric actuator unit 50 includes an upper electrode 51, a filler layer 52, a piezoelectric material layer 53, an oscillating plate 54, a lower electrode 55 and a protective layer 56, and is different from the piezoelectric actuator unit 40 in that the protective layer 56 is additionally formed on the lower surface of the lower electrode 55. The protective layer 56 is made of polyimide-based synthetic resin material or metallic material such as stainless steel, and is fixed onto the lower surface of the lower electrode 55 by an adhesive. In this modification, the lower electrode 55 is protected by the protective layer 56, against damaging or deterioration which could be caused if the electrode 55 were in contact with the liquid accommodated in the pressure chamber 21*a*.

It is noted that the upper electrode 51, filler layer 52, piezoelectric material layer 53, oscillating plate 54 and lower electrode 55 in this modification are identical with those in the second embodiment, and that redundant description of these elements is not provided.

Figure 10:
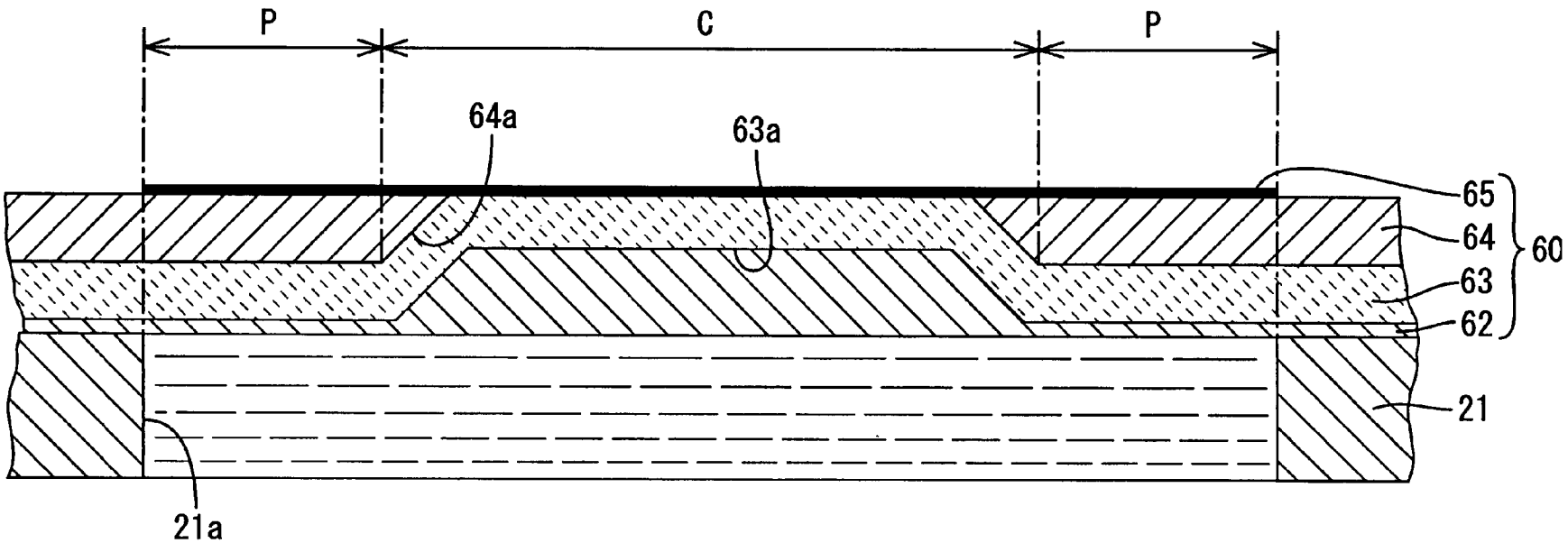
FIG. 10 is a cross sectional view showing in enlargement a main part of a liquid delivering device constructed according to a second modification of the second embodiment of the invention.

FIG. 10 shows a piezoelectric actuator unit 60 as a second modification of the above-described piezoelectric actuator unit 40 of the second embodiment. This piezoelectric actuator unit 60 includes an upper electrode 65, a filler layer 62, a piezoelectric material layer 63 and an oscillating plate 64. The oscillating plate 64 has a through-hole 64*a* formed therethrough such that the through-hole 64*a* is located in the central region C of each active portion of the actuator unit 60. The through-hole 64*a* is defined by a tapered or slant surface such that its cross sectional area decreases as viewed in the upward direction, as shown in FIG. 10. The piezoelectric material layer 63 is fixed onto the lower surface of the oscillating plate 64, and is bent to have a recess 63*a* in its lower surface. The filler layer 62 is fixed onto the lower surface of the piezoelectric material layer 63, and includes an embedded portion and a non-embedded portion which are contiguous with each other. The embedded portion of the filler layer 62 is embedded in the recess 63*a*, while the non-embedded portion of the filler layer 62 is located in the outer region P of each active portion.

The upper electrode 65 is disposed on the upper surfaces of the non-interposed portion of the piezoelectric material layer 63 and the oscillating plate 64, and cooperates with the filler layer 62 (made of a conductive material) to constitute a pair of electrodes to which the drive voltage is to be applied. In this second modification of the second embodiment, the non-interposed portion of the piezoelectric material layer 63 located in the central region C of each active portion is offset from a center of the actuator unit 60 in a direction away from the passage-defining unit 20 as viewed in a thickness direction of the actuator unit 60, while a portion of the piezoelectric material layer 63 located in the outer region P of each active portion is offset from the center of the actuator unit 60 in a direction toward the passage-defining unit 20 as viewed in the thickness direction of the actuator unit 60. Upon application of the drive voltage between the pair of electrodes, the central region C of the active portion of the actuator unit 60 is deformed to be convexed in a direction toward the pressure chamber 21*a* (i.e., in the downward direction as seen in FIG. 10), while the outer region P of the active portion of the actuator unit 60 is deformed to be convexed in a direction away from the pressure chamber 21*a* (i.e., in the upward direction as seen in FIG. 10). It is noted that the filler layer 62, piezoelectric material layer 63 and oscillating plate 64 in this second modification are identical with those in the second embodiment, and that the upper electrode 65 in this second modification is identical with the lower electrode 45 in the second embodiment. Redundant description of these elements is not provided.

Figure 11:
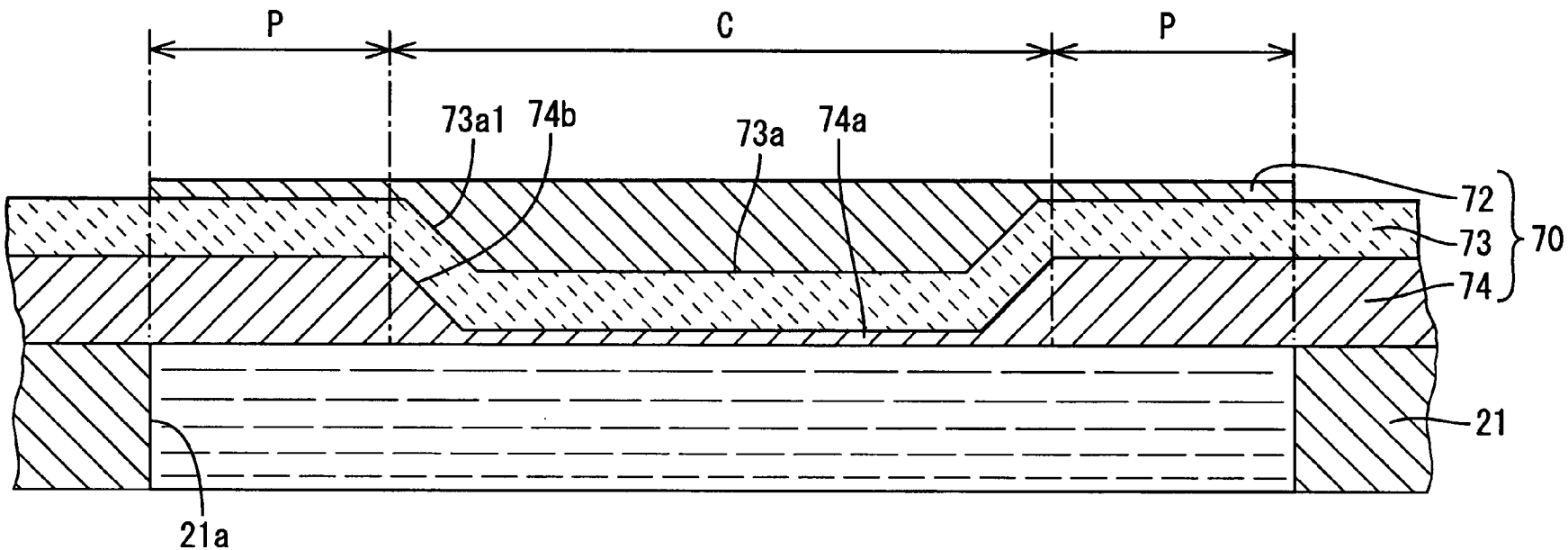
FIG. 11 is a cross sectional view showing in enlargement a main part of a liquid delivering device constructed according to a third embodiment of the invention.

Referring next to FIG. 11, there will be described a third embodiment of the invention. In this third embodiment, the liquid delivering device 1 is equipped with a piezoelectric actuator unit 70 which includes a filler layer 72, a piezoelectric material layer 73 and an oscillating plate 74. The filler layer 72 includes an embedded portion and a non-embedded portion which are contiguous with each other. The embedded portion of the filler layer 72 is embedded in the recess 73*a* of the piezoelectric material layer 73 while the non-embedded portion of the filler layer 72 covers the upper surface of a portion of the piezoelectric material layer 73 which portion is located in the outer region P of each active portion. The filler layer 72 is made of a conductive metallic material such as stainless steel, nickel, chromium, copper and aluminum, and is electrically connected to a positive terminal of an electric source of the drive circuit via a switching element, so as to serve as an upper electrode of the actuator unit 70.

Where the filler layer 72 is made of stainless steel, the filler layer 72 is formed to have the above-described embedded portion and non-embedded portion, and is then fixed onto the upper surface of the piezoelectric material layer 73 by a conductive adhesive. Where the filler layer 72 is made of nickel, chromium, copper or aluminum, the filler layer 72 may be fixed onto the upper surface of the piezoelectric material layer 73 by either a conductive adhesive or aerosol deposition method after being formed to have the above-described embedded portion and non-embedded portion. Further, in the latter case, the filler layer 72 may be formed on the upper surface of the piezoelectric material layer 73 by electroforming, plating, vapor-deposition or sputtering.

As in the first embodiment, the oscillating plate 74 of the actuator unit 70 has a thin-walled portion 74*a* in which the oscillating plate 74 is recessed at its upper surface by machining or etching. The piezoelectric material layer 73, which is provided by a layer having a constant thickness, is fixed onto the upper surface of the oscillating plate 74 so that its upper surface is made lower in its portion located right above the thin-walled portion 74*a* of the oscillating plate 74, than in the other portion of the layer 73. Thus, the piezoelectric material layer 73 is bent to have a recess 73*a* formed in its upper surface, i.e., in one of its opposite side surfaces that is remote from the pressure chamber 21*a*. The recess 73*a* is connected to the other portion of the piezoelectric material layer 73 via a slant surface 73*a*1 which surrounds the recess 73*a*. Thus, a portion of the piezoelectric material layer 73 located in the central region C of the active portion is given a cup-like shape. The piezoelectric material layer 73 may be formed on the oscillating plate 74 by either aerosol deposition method, sputtering, or sol-gel method. Further, alternatively, the piezoelectric material layer 73 is provided by a layer, which is fixed to the oscillating plate 74 by a conductive adhesive after the layer has been formed to have a predetermined shape.

The oscillating plate 74, which defines the upper end of the pressure chamber 21*a*, is provided by a generally flat plate made of a conductive metallic material such as stainless steel, and is used as a lower electrode which is grounded and constitutes a part of the drive circuit. It is noted that the thin-walled portion 74*a* is connected to the other portion via a slant surface 74*b* which surrounds the thin-walled portion 74*a*.

Owing to the construction as described above, a portion of the piezoelectric material layer 73 located in the central region C of the active portion is offset from a center of the actuator unit 70 in a direction toward the passage-defining unit 20 as viewed in a thickness direction of the actuator unit 70, while a portion of the piezoelectric material layer 73 located in the outer region P of the active portion is offset from the center of the actuator unit 70 in a direction away from the passage-defining unit 20 as viewed in the thickness direction of the actuator unit 70.

In the central region C, the embedded potion of the filler layer 72 (embedded in the recess 73*a*) is given a rigidity higher than that of the thin-walled portion 74*a* of the oscillating plate 74, irrespective of kinds of materials selected to form the filler layer 72 and the oscillating plate 74. On the other hand, in the outer region P, the oscillating plate 74 fixed onto the lower surface of the piezoelectric material layer 73 is given a rigidity higher than that of the filler layer 72 fixed onto the upper surface of the piezoelectric material layer 73, irrespective of kinds of materials selected to form the filler layer 72 and the oscillating plate 74.

In the piezoelectric actuator unit 70 of this third embodiment, upon application of the drive voltage between the filler layer 72 and the oscillating plate 74 with the switching element being turned ON, the central region C of the active portion of the actuator unit 70 is deformed to be convexed in a direction away from the pressure chamber 21*a*, since the rigidity of the filler layer 72 is higher than that of the oscillating plate 74 in the central region C, as described above. Meanwhile, the outer region P of the active portion of the actuator unit 70 is deformed to be convexed in a direction toward the pressure chamber 21*a*, since the rigidity of the filler layer 72 is lower than that of the oscillating plate 74 in the central region C, as described above. Since the piezoelectric actuator unit 70 is activated or operated in the same manner as the actuator unit 10 of the first embodiment, redundant description of the operation of the actuator unit 70 is not provided.

In this third embodiment, the filler layer 72 is made of a conductive material and is held in contact with the upper surface of the piezoelectric material layer 73 in the outer region P as well as in the center region C of each active portion of the actuator unit 70. Thus, the filler layer 72 can serve as the upper electrode which cooperates with the oscillating plate 74 as the lower electrode for generating the electric field across the piezoelectric material layer 73. This arrangement eliminates necessity of provision of a member serving exclusively as the upper electrode, thereby reducing the manufacturing cost. Further, the filler layer 72 may be made of the same material as the oscillating plate 74, so as to have the same coefficient of thermal expansion as the oscillating plate 74, thereby making it possible to advantageously minimize a stress acting on the piezoelectric material layer 73 (which is fixed to both of the filler layer 72 and the oscillating plate 74) even under a condition with considerable variation in temperature. This technical advantage can be obtained, even where the filler layer 72 and the oscillating plate 74 are made of respective materials different from each other as long as the respective materials have the same coefficient of thermal expansion.

The piezoelectric actuator unit 70 of this third embodiment may be modified as needed. For instance, a lower electrode may be interposed between the piezoelectric material layer 73 and the oscillating plate 74, as in the piezoelectric actuator unit 30 of FIG. 7. Further, a through-hole may be formed through the portion of the oscillating plate 74 which is located in the central region C of each active portion, as in the piezoelectric actuator unit 40 of FIG. 8.

In the piezoelectric actuator unit 70, the filler layer 72 is disposed on one of opposite sides of the piezoelectric material layer 73 that is remote from the pressure chamber 21*a*. However, the filler layer 72 may be disposed on the other side of the piezoelectric material layer 73 that is close to the pressure chamber 21*a*, so that the central region C of each active portion is deformed to be convexed in the direction toward the pressure chamber 21*a*, upon application of the drive voltage to the actuator unit 70. Further, while the thin-walled portion of the oscillating plate 74 and the recess of the piezoelectric material layer 73 are positioned in the central region C of each active portion in the piezoelectric actuator unit 70, the thin-walled portion and the recess may be positioned in the outer region P which surrounds the central region C, so that the central region C of each active portion is deformed to be convexed in the direction toward the pressure chamber 21*a*.

Figure 12:
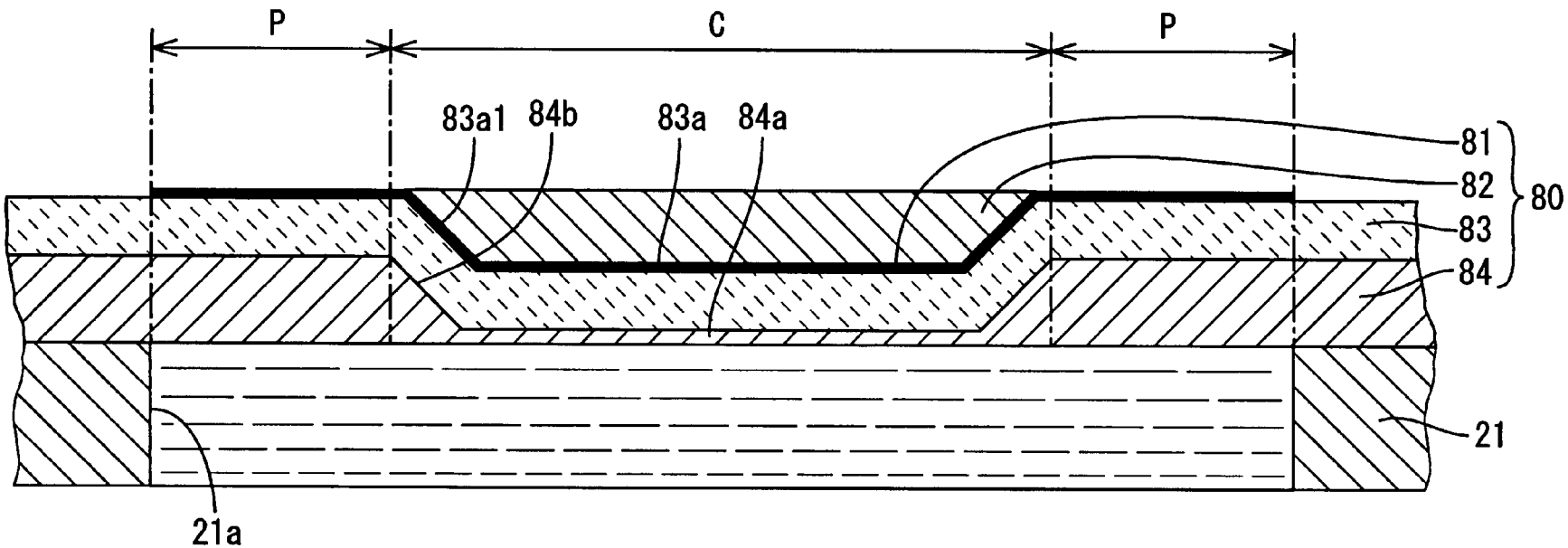
FIG. 12 is a cross sectional view showing in enlargement a main part of a liquid delivering device constructed according to a fourth embodiment of the invention.

Referring next to FIG. 12, there will be described a fourth embodiment of the invention. In this fourth embodiment, the liquid delivering device 1 is equipped with a piezoelectric actuator unit 80 which includes an upper electrode 81, a filler layer 82, a piezoelectric material layer 83 and an oscillating plate 84. The filler layer 82 is embedded in a recess 83*a* of the piezoelectric material layer 83 located in the central region C of the active portion. The piezoelectric material layer 83 includes a non-interposed portion located in the outer region P of the active portion. The upper electrode 81 has an interposed portion and an exposed portion contiguous with each other. The interposed portion of the upper electrode 81 is located in the central region C and is interposed between the filler layer 82 and the piezoelectric material layer 83. The exposed portion of the upper electrode 81 is located in the outer region P and is disposed on the upper surface of the non-interposed portion of the piezoelectric material layer 83. Like the upper electrode 11 of the first embodiment, the upper electrode 81 is provided by a thin conductive film which is bonded to or printed on the piezoelectric material layer 83, and is electrically connected to a positive terminal of an electric source of the drive circuit via a switching element.

The filler layer 82, which is embedded in the recess 83*a* of the piezoelectric material layer 83, is fixed onto the piezoelectric material layer 83 via the upper electrode 81. Where the filler layer 82 is made of stainless steel, the filler layer 82 is formed to have a shape conforming to that of the recess 83*a*, and is then fixed onto the upper surface of the piezoelectric material layer 83 via the upper electrode 81 by a conductive adhesive. Where the filler layer 82 is made of nickel, chromium, copper or aluminum, the filler layer 82 may be fixed into the recess 83*a* by either a conductive adhesive or aerosol deposition method after being formed to have the shape conforming to the shape of the recess 83*a*. Further, in the latter case, the filler layer 82 may be formed in the recess 83*a* by electroforming, plating, vapor-deposition or sputtering. In this fourth embodiment, the filler layer 82 does not have to be made of a conductive material, but may be formed of a metallic, synthetic resin, ceramic or any other material.

On the lower surface of the piezoelectric material layer 83, there is disposed the oscillating plate 84 which is provided by a generally flat plate made of a conductive metallic material such as stainless steel, like the oscillating plate 14 of the first embodiment. This oscillating plate 84 defines the upper end of the pressure chamber 21*a*, and is used as a lower electrode which is grounded and constitutes a part of the drive circuit. The oscillating plate 84 has a thin-walled portion 84*a* located in the central region C of the active portion. In the thin-walled portion 84*a*, the oscillating plate 84 is recessed at its upper surface (i.e., its surface remote from the pressure chambers 21*a*), by machining or etching. This thin-walled portion 84*a* is connected to the other portion via a slant surface 84*b* which surrounds each thin-walled portion 84*a*.

The piezoelectric material layer 83, which is provided by a layer having a constant thickness, is fixed onto the upper surface of the oscillating plate 84, so that its upper surface is made lower in its portions located right above the thin-walled portions 84*a* of the oscillating plate 84, than in the other portion of the layer 83. Thus, the piezoelectric material layer 83 is bent to have the above-described recess 83*a* formed in its upper surface. The recess 83*a* is connected to the other portion of the piezoelectric material layer 83 via a slant surface 83*a*1 which surrounds each recess 83*a*. Thus, a portion of the piezoelectric material layer 83 located in the central region C of the active portion is given a cup-like shape. The piezoelectric material layer 83 may be formed on the oscillating plate 84 by either aerosol deposition method, sputtering, or sol-gel method. Further, alternatively, the piezoelectric material layer 83 is provided by a layer, which is fixed to the oscillating plate 84 by a conductive adhesive after the layer has been formed to have a predetermined shape.

Further, the filler layer 82 may be made of the same material as the oscillating plate 84, so as to have the same coefficient of thermal expansion as the oscillating plate 84, thereby making it possible to advantageously minimize a stress acting on the piezoelectric material layer 83 (which is fixed to both of the filler layer 82 and the oscillating plate 84) even under a condition with considerable variation in temperature. This technical advantage can be obtained, even where the filler layer 82 and the oscillating plate 84 are made of respective materials different from each other as long as the respective materials have the same coefficient of thermal expansion. It is noted that the filler layer 82 is given a rigidity higher than that of the thin-walled portion 84*a* of the oscillating plate 84, irrespective of kinds of materials selected to form the filler layer 82 and the oscillating plate 84.

Owing to the construction as described above, a portion of the piezoelectric material layer 83 located in the central region C of the active portion is offset from a center of the actuator unit 80 in a direction toward the passage-defining unit 20 as viewed in a thickness direction of the actuator unit 80, while a portion of the piezoelectric material layer 83 located in the outer region P of the active portion is offset from the center of the actuator unit 80 in a direction away from the passage-defining unit 20 as viewed in the thickness direction of the actuator unit 80. In the piezoelectric actuator unit 80 of this fourth embodiment, upon application of the drive voltage between the filler layer 82 and the oscillating plate 84 with the switching element being turned ON, the central region C of the active portion of the actuator unit 80 is deformed to be convexed in a direction away from the pressure chamber 21*a*, since the rigidity of the filler layer 82 is higher than that of the oscillating plate 84 in the central region C, as described above. Meanwhile, the outer region P of the active portion of the actuator unit 80 is deformed to be convexed in a direction toward the pressure chamber 21*a*. Since the piezoelectric actuator unit 80 is activated or operated in the same manner as the actuator unit 10 of the first embodiment, redundant description of the operation of the actuator unit 80 is not provided.

In the piezoelectric actuator unit 80 of this fourth embodiment, the upper electrode 81 includes the interposed portion interposed between the filler layer 82 and the piezoelectric material layer 83 in addition to the exposed portion disposed on the upper surface of the non-interposed portion of the piezoelectric material layer 83, so that the upper electrode 81 is held in direct contact with the piezoelectric material layer 83 not only in the outer region P but also in the central region C. Owing to this arrangement, the filler layer 82 does not have to be used as the electrode and accordingly does not have to be made of a conductive material, but may be made of a non-conductive material. Further, a through-hole may be formed through the portion of the oscillating plate 84 which is located in the central region C of the active portion, as in the piezoelectric actuator unit 40 of FIG. 8.

Figure 13:
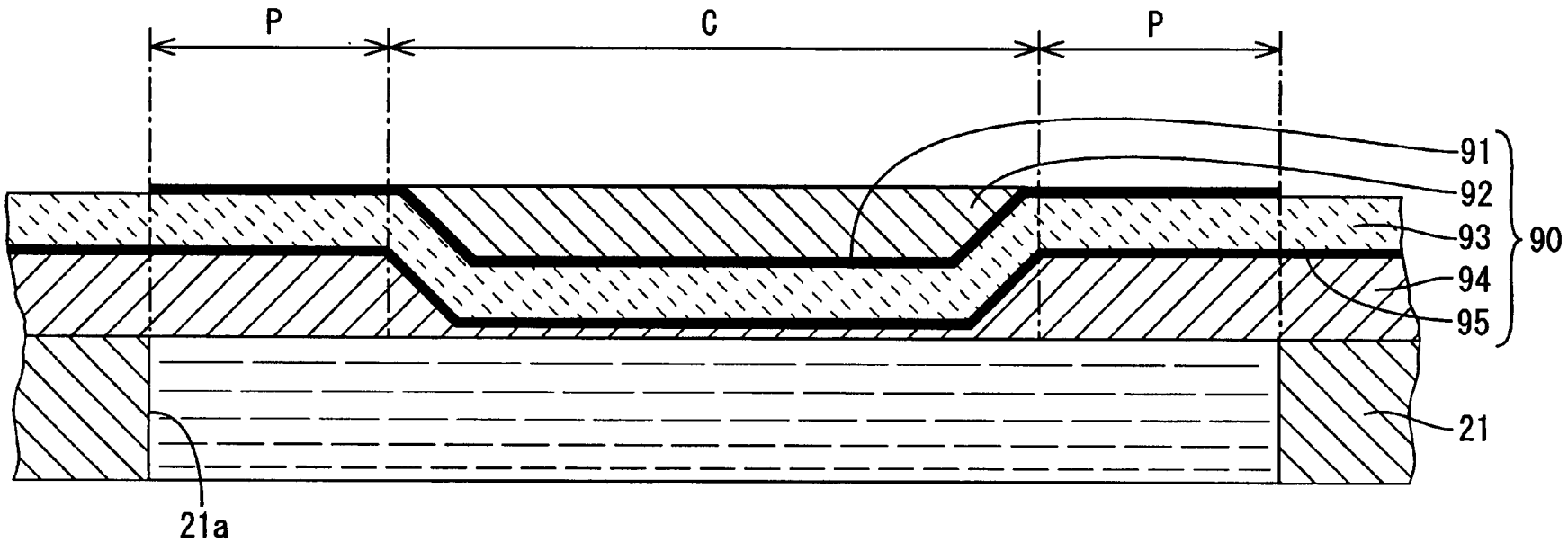
FIG. 13 is a cross sectional view showing in enlargement a main part of a liquid delivering device constructed according to a modification of the fourth embodiment of the invention.

FIG. 13 shows a piezoelectric actuator unit 90 as a modification of the above-described piezoelectric actuator unit 80 of the fourth embodiment. This piezoelectric actuator unit 90 includes an upper electrode 91, a filler layer 92, a piezoelectric material layer 93, an oscillating plate 94 and a lower electrode 95, and is different from the piezoelectric actuator unit 80 in that the lower electrode 95 is interposed between the piezoelectric material layer 93 and the oscillating plate 94. Like the upper electrode 81 of the actuator unit 80, the lower electrode 95 is provided by a thin conductive film which is bonded to or printed on the oscillating plate 94, and the piezoelectric material layer 93 is then fixed onto the lower electrode 95 by a conductive adhesive, aerosol deposition method, sol-gel method or sputtering method.

In this modification, the lower electrode 95 is provided between the piezoelectric material layer 93 and the oscillating plate 94, without the lower electrode 95 being exposed to the exterior. Therefore, the lower electrode 95 is protected against damaging or deterioration which could be caused if the electrode 95 were in contact with the liquid accommodated in the pressure chamber 21*a*. Further, since the oscillating plate 94 does not have to be made of a conductive material but may be made of any material, it is possible to reduce the cost of manufacture of the actuator unit 90.

It is noted that the upper electrode 91, filler layer 92, piezoelectric material layer 93 and oscillating plate 94 in this modification are identical with those in the fourth embodiment, and that redundant description of these elements is not provided.

In the above-described piezoelectric actuator units 80, 90, the filler layer 82 or 92 is disposed on one of opposite sides of the piezoelectric material layer 83 or 93 that is remote from the pressure chamber 21*a*. However, the filler layer 82 or 92 may be disposed on the other side of the piezoelectric material layer 83 or 93 that is close to the pressure chamber 21*a*, so that the central region C of the active portion is deformed to be convexed in the direction toward the pressure chamber 21*a*, upon application of the drive voltage to the actuator unit 80 or 90. Further, while the thin-walled portion of the oscillating plate 84 or 94 and the recess of the piezoelectric material layer 83 or 93 are positioned in the central region C of the active portion in the piezoelectric actuator unit 80 or 90, the thin-walled portion and the recess may be positioned in the outer region P which surrounds the central region C, so that the central region C of each active portion is deformed to be convexed in the direction toward the pressure chamber 21*a*.

Figure 14:
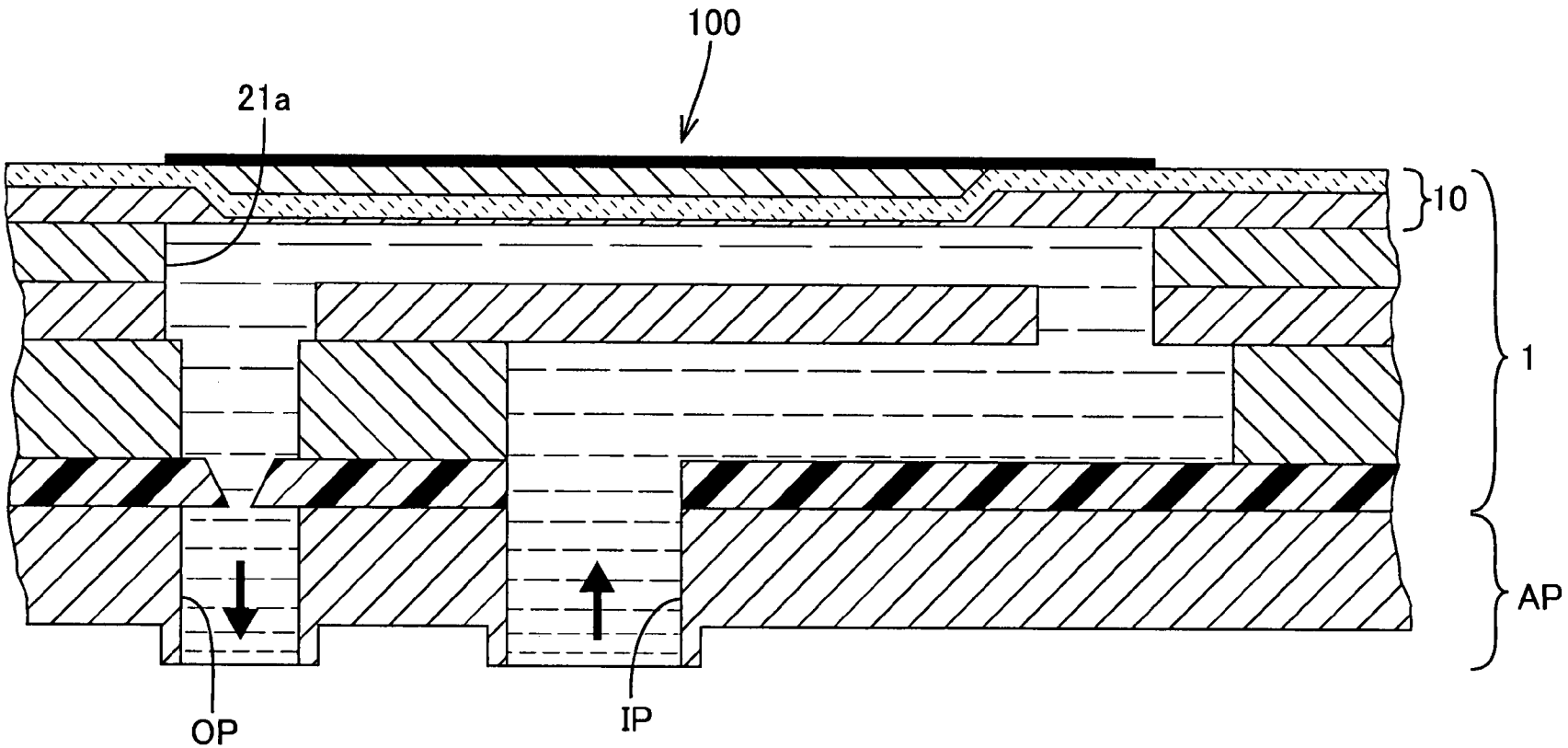
FIG. 14 is a cross sectional view of a micro pump which incorporates the liquid delivering device of FIG. 1.

FIG. 14 shows a fifth embodiment of the present invention in which the liquid delivering device 1 of the first embodiment is incorporated in a micro pump 100. This micro pump 100 includes, in addition to the liquid delivering device 1, a pump adaptor AP which has an inlet port IP and a plurality of outlet ports OP. The adapter AP is connected to a lower surface of the liquid delivering device 1, and is immersed at its lower portion in the liquid reserved in a liquid reservoir. By deflecting or deforming the piezoelectric actuator unit 10 away from one of the pressure chambers 21*a* in the liquid delivering device 1, the volume of the pressure chamber 21*a* is increased whereby the pressure chamber 21*a* is refilled with the liquid delivered thereto from the liquid reservoir through the inlet port IP, and the liquid is then delivered from the pressure chamber 21*a* to the exterior of the micro pump 100 through a corresponding one of the outlet ports OP.

While the presently preferred embodiments of the present invention have been described above in detail, it is to be understood that the invention is not limited to the details of the illustrated embodiments, but may be otherwise embodied.

In the above-described embodiments, the upper electrode or the filler layer (serving as the upper electrode) is connected to the positive terminal of the electric source of the drive circuit, while the lower electrode or the oscillating plate (serving as the lower electrode) is grounded. However, such an electrical arrangement may be modified such that the upper electrode is grounded while the lower electrode is connected to the positive terminal of the electric source.

The term "delivering" of, the liquid delivering device according to the present invention may be interpreted to mean either spouting, emitting, ejecting, jetting or otherwise delivering. Further, the liquid delivering device may be arranged such that the liquid takes the form of either droplet or mist, after it has been spouted, emitted, ejected or jetted out of the device through outlets such as nozzles which are held in communication with the respective pressure chambers. In this sense, the liquid delivering device may be referred also to as a fluid delivering device.

The liquid delivering device according to the present invention may be arranged to deliver any kinds of liquid to the exterior of the device. That is, the liquid delivering device of the present invention encompasses, for example, an inkjet print head arranged to eject an ink as the liquid through nozzles and an ejection device arranged to eject a reagent used for an inspection.

Figure 15:
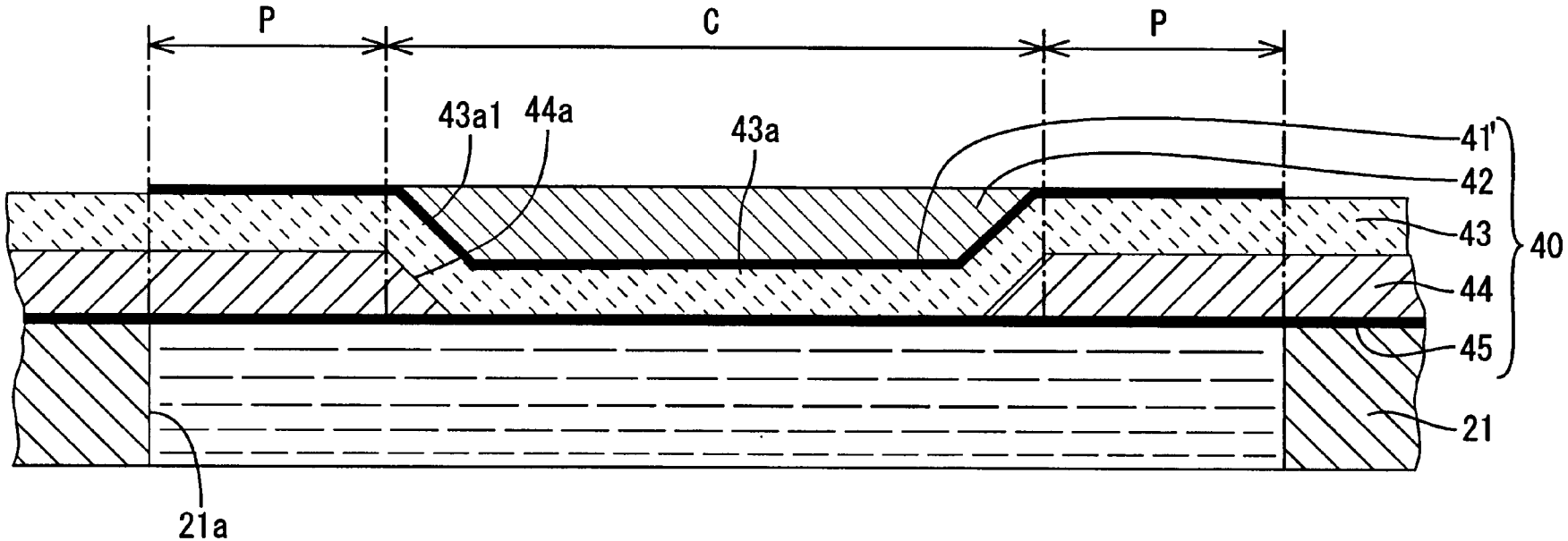
FIG. 15 is a cross sectional view showing in enlargement a main part of a liquid delivering device constructed according to another modification of the second embodiment of the invention.

Further, the above-described piezoelectric material unit 40 of FIG. 8 may be modified, as shown in FIG. 15, such that the upper electrode 41 is replaced with an upper electrode 41', which has an interposed portion interposed between the filler layer 42 and the piezoelectric material layer 43 in the central region C of the active portion, as the upper electrode 81 of the actuator unit 80 of FIG. 12. In this modified arrangement, the filler layer 42 does not have to be used as the upper electrode and accordingly does not have to be made of a conductive material, but may be made of a non-conductive material.

Figure 16:
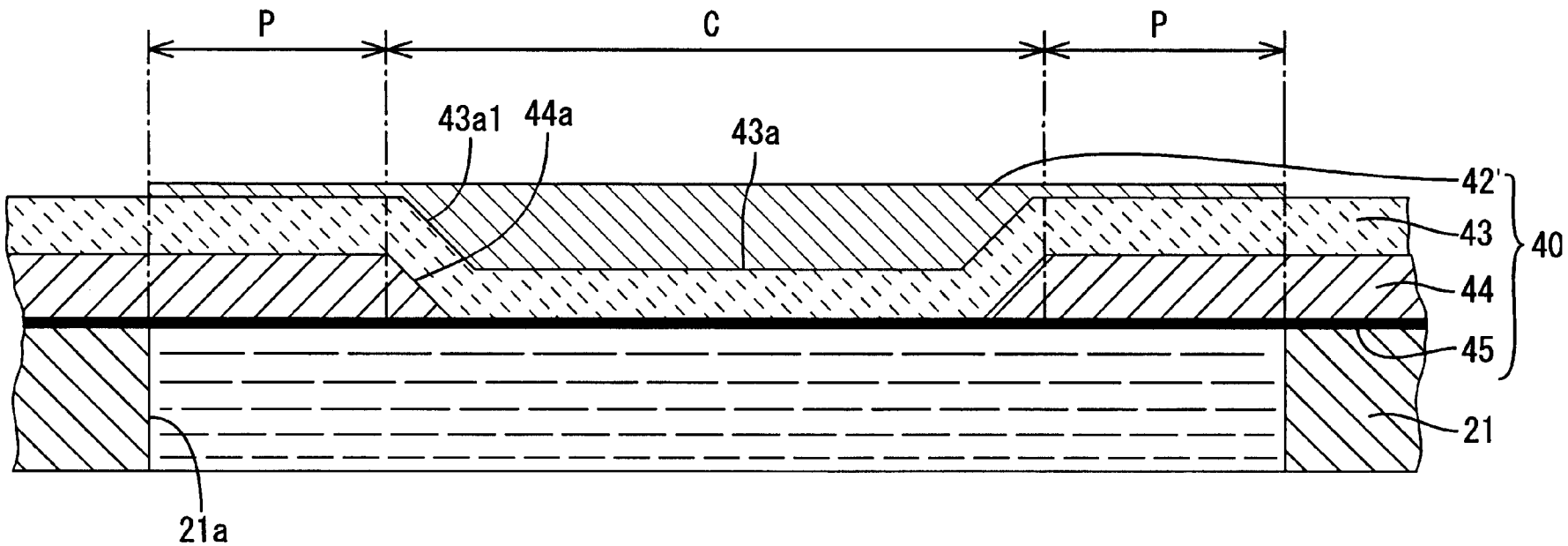
FIG. 16 is a cross sectional view showing in enlargement a main part of a liquid delivering device constructed according to still another modification of the second embodiment of the invention.

Still further, the above-described piezoelectric material unit 40 of FIG. 8 may be modified, as shown in FIG. 16, such that the filler layer 42 is replaced with a filler layer 42', which is arranged to be held in contact with the piezoelectric material layer 43 not only in the central region C but also in the outer region P, as the filler layer 72 of the actuator unit 70 of FIG. 11. In this modified arrangement, the filler layer 42' is made of a conductive material so as to serve as an upper electrode, thereby eliminating necessity of provision of a member serving exclusively as the upper electrode.

Figure 17:
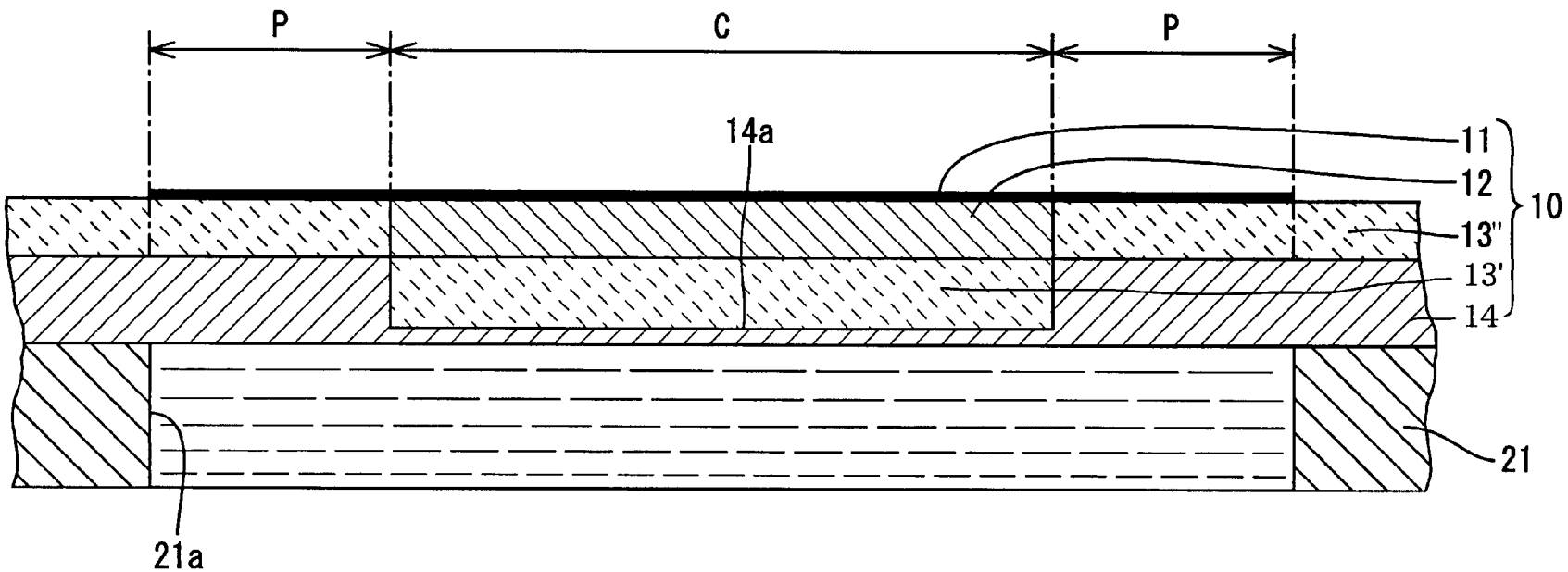
FIG. 17 is a cross sectional view showing in enlargement a main part of a liquid delivering device constructed according to another modification of the first embodiment of the invention.

In the above-described embodiments, the piezoelectric material layer of the actuator unit is provided by a single layer. However, the piezoelectric material layer may consist of a plurality of layers separated from each other, as in a modified arrangement shown in FIG. 17 in which a lower piezoelectric material layer 13' located in the central region C of the active portion is offset from a center of the actuator unit 10 in a direction toward the passage-defining unit 20 as viewed in a thickness direction of the actuator unit 10, while an upper piezoelectric material layer 13" located in the outer region P of the active portion is offset from the center of the actuator unit 10 in a direction away from the passage-defining unit 20 as viewed in the thickness direction of the actuator unit 10.

It is to be understood that the present invention may be embodied with various other changes, modifications and improvements, which may occur to those skilled in the art, without departing from the sprit and scope of the invention.

What is claimed is:

1. A liquid delivering device comprising:

(a) a cavity unit defining a plurality of pressure chambers for accommodating a liquid which is to be delivered to an exterior of said liquid delivering device; and (b) a piezoelectric actuator unit superposed on said cavity unit, and having a plurality of active portions which are opposed to the respective pressure chambers and which are selectively deformable upon application of a drive voltage thereto so as to deliver the liquid from the corresponding pressure chambers to the exterior of said liquid delivering device, wherein said piezoelectric actuator unit has a plate-like shape, and includes (b-1) a piezoelectric material layer which is deformable at least in a direction parallel thereto upon generation of an electric field therein as a result of the application of the drive voltage to said piezoelectric actuator unit, (b-2) a first flexible layer which is laminated on one of opposite side surfaces of said piezoelectric material layer, and (b-3) a second flexible layer which is laminated on the other of said opposite side surfaces of said piezoelectric material layer, wherein a portion of said piezoelectric material layer located in a central region of each of said active portions is offset from a center of said piezoelectric actuator unit, as viewed in a thickness direction of said piezoelectric actuator unit, in one of a direction toward said cavity unit and a direction away from said cavity unit, while a portion of said piezoelectric material layer located in an outer region of each of said active portions is offset from said center of said piezoelectric actuator unit, as viewed in said thickness direction, in the other of said direction toward said cavity unit and said direction away from said cavity unit, said liquid delivering device further comprising a plurality of nozzles which are held in communication with the respective pressure chambers and through which an ink as the liquid accommodated in said pressure chambers is ejected to the exterior of said liquid delivering device, so that said liquid deliver device constitutes an inkjet print head.

2. The liquid delivering device according to claim 1, wherein said piezoelectric material layer of said plate-like piezoelectric actuator unit is bent in each of said active portions.

3. The liquid delivering device according to claim 1, wherein said first flexible layer has a small thickness in one of said central region and said outer region of each of said active portions, and a large thickness, which is larger than said small thickness, in the other of said central region and said outer region, wherein said piezoelectric material layer interposed between said first and second flexible layers has a recess in said other of said opposite side surfaces thereof, such that said recess is located in said one of said central region and said outer region of each of said active portions, wherein said second flexible layer includes an embedded portion embedded in said recess which is located in said one of said central region and said outer region of each of said active portions, and wherein said central region and said outer region of each of said active portions of said piezoelectric actuator unit, upon application of the drive voltage to said each of said active portions, are deformed to be convexed in respective directions which are opposite to each other.

4. The liquid delivering device according to claim 3, wherein said first flexible layer is formed of a conductive material so as to serve as one of a pair of electrodes through which the drive voltage is applied to each of said active portions of said piezoelectric actuator unit.

5. The liquid delivering device according to claim 3, wherein said second flexible layer further includes a portion which is contiguous with said embedded portion and which is located in said other of said central region and said outer region of each of said active portions, and wherein said second flexible layer is formed of a conductive material, and serves as one of a pair of electrodes through which the drive voltage is applied to each of said active portions of said piezoelectric actuator unit.

6. The liquid delivering device according to claim 1, wherein said first flexible layer and said second flexible layer are formed of respective materials having substantially the same coefficient of thermal expansion.

7. The liquid delivering device according to claim 1, wherein said first flexible layer and said second flexible layer are formed of substantially the same material.

8. The liquid delivering device according to claim 1, wherein said portion of said piezoelectric material layer located in said central region of each of said active portions and said portion of said piezoelectric material layer located in said outer region of each of said active portions are separated from each other.

9. A liquid delivering device comprising:

(a) a cavity unit defining a plurality of pressure chambers for accommodating a liquid which is to be delivered to an exterior of said liquid delivering device; and (b) a piezoelectric actuator unit superposed on said cavity unit, and having a plurality of active portions which are opposed to the respective pressure chambers and which are selectively deformable upon application of a drive voltage thereto so as to deliver the liquid from the corresponding pressure chambers to the exterior of said liquid delivering device, wherein said piezoelectric actuator unit has a plate-like shape, and includes (b-1) a piezoelectric material layer which is deformable at least in a direction parallel thereto upon generation of an electric field therein as a result of the application of the drive voltage to said piezoelectric actuator unit, (b-2) a first flexible layer which is laminated on one of opposite side surfaces of said piezoelectric material layer, and (b-3) a second flexible layer which is laminated on the other of said opposite side surfaces of said piezoelectric material layer, wherein a portion of said piezoelectric material layer located in a central region of each of said active portions is offset from a center of said piezoelectric actuator unit, as viewed in a thickness direction of said piezoelectric actuator unit, in one of a direction toward said cavity unit and a direction away from said cavity unit, while a portion of said piezoelectric material layer located in an outer region of each of said active portions is offset from said center of said piezoelectric actuator unit, as viewed in said thickness direction, in the other of said direction toward said cavity unit and said direction away from said cavity unit, wherein said first flexible layer has a through-hole formed therethrough, such that said through-hole is located in said central region of each of said active portions, wherein said piezoelectric material layer interposed between said first and second flexible layers has a recess in said other of said opposite side surfaces thereof, such that said recess is located in said central region of each of said active portions, wherein said second flexible layer has an embedded portion embedded in said recess which is located in said central region of each of said active portions, and wherein said central region and said outer region of each of said active portions of said piezoelectric actuator unit, upon application of the drive voltage to said each of said active portions, are deformed to be convexed in respective directions which are opposite to each other.

10. The liquid delivering device according to claim 9, wherein said piezoelectric material layer includes a non-interposed portion which is located inside said through-hole and which has a surface contiguous with one of opposite side surfaces of said first flexible layer that is remote from said piezoelectric material layer, wherein said first flexible layer is formed of a conductive material, and wherein said piezoelectric actuator unit further includes an electrode which is held in contact with said surface of said non-interposed portion of said piezoelectric material layer and said one of the opposite side surfaces of said first flexible layer, and which serves as one of a pair of electrodes through which the drive voltage is applied to each of said active portions of said piezoelectric actuator unit.

11. The liquid delivering device according to claim 10, wherein said piezoelectric actuator unit further includes a protective layer which is disposed on one of opposite sides of said electrode that is remote from said first flexible layer.

12. The liquid delivering device according to claim 9, wherein said piezoelectric material layer includes a non-interposed portion which is located in said outer region of each of said active portions, and which has a surface contiguous with one of opposite side surfaces of said second flexible layer that is remote from said piezoelectric material layer, wherein said second flexible layer is formed of a conductive material, and wherein said piezoelectric actuator unit further includes an electrode which is held in contact with said surface of said non-interposed portion of said piezoelectric material layer and said one of the opposite side surfaces of said second flexible layer, and which serves as one of a pair of electrodes through which the drive voltage is applied to each of said active portions of said piezoelectric actuator unit.

13. The liquid delivering device according to claim 9, wherein said second flexible layer is formed of a non-conductive material, and wherein said piezoelectric actuator unit further includes an electrode which has an interposed portion interposed between said piezoelectric material layer and said second flexible layer, such that said electrode serves as one of a pair of electrodes through which the drive voltage is applied to each of said active portions of said piezoelectric actuator unit.

14. The liquid delivering device according to claim 13, wherein said piezoelectric material layer includes a non-interposed portion which is located in said outer region of each of said active portions, and wherein said electrode includes, in addition to said interposed portion, an exposed portion which is disposed on said non-interposed portion of said piezoelectric material layer.

15. The liquid delivering device according to claim 9, wherein said second flexible layer further includes a portion which is contiguous with said embedded portion and which is located in said outer region of each of said active portions, and wherein said second flexible layer is formed of a conductive material, and serves as one of a pair of electrodes through which the drive voltage is applied to each of said active portions of said piezoelectric actuator unit.

16. A liquid delivering device comprising:

(a) a cavity unit defining a plurality of pressure chambers for accommodating a liquid which is to be delivered to an exterior of said liquid delivering device; and (b) a piezoelectric actuator unit superposed on said cavity unit, and having a plurality of active portions which are opposed to the respective pressure chambers and which are selectively deformable upon application of a drive voltage thereto so as to deliver the liquid from the corresponding pressure chambers to the exterior of said liquid delivering device, wherein said piezoelectric actuator unit has a plate-like shape, and includes (b-1) a piezoelectric material layer which is deformable at least in a direction parallel thereto upon generation of an electric field therein as a result of the application of the drive voltage to said piezoelectric actuator unit, (b-2) a first flexible layer which is laminated on one of opposite side surfaces of said piezoelectric material layer, and (b-3) a second flexible layer which is laminated on the other of said opposite side surfaces of said piezoelectric material layer, wherein a portion of said piezoelectric material layer located in a central region of each of said active portions is offset from a center of said piezoelectric actuator unit, as viewed in a thickness direction of said piezoelectric actuator unit, in one of a direction toward said cavity unit and a direction away from said cavity unit, while a portion of said piezoelectric material layer located in an outer region of each of said active portions is offset from said center of said piezoelectric actuator unit, as viewed in said thickness direction, in the other of said direction toward said cavity unit and said direction away from said cavity unit, wherein said first flexible layer has a small thickness in one of said central region and said outer region of each of said active portions, and a large thickness, which is larger than said small thickness, in the other of said central region and said outer region, wherein said piezoelectric material layer interposed between said first and second flexible layers has a recess in said other of said opposite side surfaces thereof, such that said recess is located in said one of said central region and said outer region of each of said active portions, wherein said second flexible layer includes an embedded portion embedded in said recess which is located in said one of said central region and said outer region of each of said active portions, wherein said central region and said outer region of each of said active portions of said piezoelectric actuator unit, upon application of the drive voltage to said each of said active portions, are deformed to be convexed in respective directions which are opposite to each other, wherein said first flexible layer is formed of a non-conductive material, and wherein said piezoelectric actuator unit further includes an electrode which is interposed between said piezoelectric material layer and said first flexible layer, such that said electrode serves as one of a pair of electrodes through which the drive voltage is applied to each of said active portions of said piezoelectric actuator unit.

17. A liquid delivering device comprising:

(a) a cavity unit defining a plurality of pressure chambers for accommodating a liquid which is to be delivered to an exterior of said liquid delivering device; and (b) a piezoelectric actuator unit superposed on said cavity unit, and having a plurality of active portions which are opposed to the respective pressure chambers and which are selectively deformable upon application of a drive voltage thereto so as to deliver the liquid from the corresponding pressure chambers to the exterior of said liquid delivering device, wherein said piezoelectric actuator unit has a plate-like shape, and includes (b-1) a piezoelectric material layer which is deformable at least in a direction parallel thereto upon generation of an electric field therein as a result of the application of the drive voltage to said piezoelectric actuator unit, (b-2) a first flexible layer which is laminated on one of opposite side surfaces of said piezoelectric material layer, and (b-3) a second flexible layer which is laminated on the other of said opposite side surfaces of said piezoelectric material layer, wherein a portion of said piezoelectric material layer located in a central region of each of said active portions is offset from a center of said piezoelectric actuator unit, as viewed in a thickness direction of said piezoelectric actuator unit, in one of a direction toward said cavity unit and a direction away from said cavity unit, while a portion of said piezoelectric material layer located in an outer region of each of said active portions is offset from said center of said piezoelectric actuator unit, as viewed in said thickness direction, in the other of said direction toward said cavity unit and said direction away from said cavity unit, wherein said first flexible layer has a small thickness in one of said central region and said outer region of each of said active portions, and a large thickness, which is larger than said small thickness, in the other of said central region and said outer region, wherein said piezoelectric material layer interposed between said first and second flexible layers has a recess in said other of said opposite side surfaces thereof, such that said recess is located in said one of said central region and said outer region of each of said active portions, wherein said second flexible layer includes an embedded portion embedded in said recess which is located in said one of said central region and said outer region of each of said active portions, wherein said central region and said outer region of each of said active portions of said piezoelectric actuator unit, upon application of the drive voltage to said each of said active portions, are deformed to be convexed in respective directions which are opposite to each other, wherein said piezoelectric material layer includes a non-interposed portion which is located in said other of said central region and said outer region of each of said active portions, and which has a surface contiguous with one of opposite side surfaces of said second flexible layer that is remote from said piezoelectric material layer, wherein said second flexible layer is formed of a conductive material, and wherein said piezoelectric actuator unit further includes an electrode which is held in contact with said surface of said non-interposed portion of said piezoelectric material layer and said one of the opposite side surfaces of said second flexible layer, and which serves as one of a pair of electrodes through which the drive voltage is applied to each of said active portions of said piezoelectric actuator unit.

18. A liquid delivering device comprising:

(a) a cavity unit defining a plurality of pressure chambers for accommodating a liquid which is to be delivered to an exterior of said liquid delivering device; and (b) a piezoelectric actuator unit superposed on said cavity unit, and having a plurality of active portions which are opposed to the respective pressure chambers and which are selectively deformable upon application of a drive voltage thereto so as to deliver the liquid from the corresponding pressure chambers to the exterior of said liquid delivering device, wherein said piezoelectric actuator unit has a plate-like shape, and includes (b-1) a piezoelectric material layer which is deformable at least in a direction parallel thereto upon generation of an electric field therein as a result of the application of the drive voltage to said piezoelectric actuator unit, (b-2) a first flexible layer which is laminated on one of opposite side surfaces of said piezoelectric material layer, and (b-3) a second flexible layer which is laminated on the other of said opposite side surfaces of said piezoelectric material layer, wherein a portion of said piezoelectric material layer located in a central region of each of said active portions is offset from a center of said piezoelectric actuator unit, as viewed in a thickness direction of said piezoelectric actuator unit, in one of a direction toward said cavity unit and a direction away from said cavity unit, while a portion of said piezoelectric material layer located in an outer region of each of said active portions is offset from said center of said piezoelectric actuator unit, as viewed in said thickness direction, in the other of said direction toward said cavity unit and said direction away from said cavity unit, wherein said first flexible layer has a small thickness in one of said central region and said outer region of each of said active portions, and a large thickness, which is larger than said small thickness, in the other of said central region and said outer region, wherein said piezoelectric material layer interposed between said first and second flexible layers has a recess in said other of said opposite side surfaces thereof, such that said recess is located in said one of said central region and said outer region of each of said active portions, wherein said second flexible layer includes an embedded portion embedded in said recess which is located in said one of said central region and said outer region of each of said active portions, wherein said central region and said outer region of each of said active portions of said piezoelectric actuator unit, upon application of the drive voltage to said each of said active portions, are deformed to be convexed in respective directions which are opposite to each other, wherein said second flexible layer is formed of a non-conductive material, and wherein said piezoelectric actuator unit further includes an electrode which has an interposed portion interposed between said piezoelectric material layer and said second flexible layer, such that said electrode serves as one of a pair of electrodes through which the drive voltage is applied to each of said active portions of said piezoelectric actuator unit.

19. The liquid delivering device according to claim 18, wherein said piezoelectric material layer includes a non-interposed portion which is located in said other of said central region and said outer region of each of said active portions, and wherein said electrode includes, in addition to said interposed portion, an exposed portion which is disposed on said non-interposed portion of said piezoelectric material layer.

20. A liquid delivering device comprising:

(a) a cavity unit defining a plurality of pressure chambers for accommodating a liquid which is to be delivered to an exterior of said liquid delivering device; and (b) a piezoelectric actuator unit superposed on said cavity unit, and having a plurality of active portions which are opposed to the respective pressure chambers and which are selectively deformable upon application of a drive voltage thereto so as to deliver the liquid from the corresponding pressure chambers to the exterior of said liquid delivering device, wherein said piezoelectric actuator unit has a plate-like shape, and includes (b-1) a piezoelectric material layer which is deformable at least in a direction parallel thereto upon generation of an electric field therein as a result of the application of the drive voltage to said piezoelectric actuator unit, (b-2) a first flexible layer which is laminated on one of opposite side surfaces of said piezoelectric material layer, and (b-3) a second flexible layer which is laminated on the other of said opposite side surfaces of said piezoelectric material layer, wherein a portion of said piezoelectric material layer located in a central region of each of said active portions is offset from a center of said piezoelectric actuator unit, as viewed in a thickness direction of said piezoelectric actuator unit, in one of a direction toward said cavity unit and a direction away from said cavity unit, while a portion of said piezoelectric material layer located in an outer region of each of said active portions is offset from said center of said piezoelectric actuator unit, as viewed in said thickness direction, in the other of said direction toward said cavity unit and said direction away from said cavity unit, wherein each of said plurality of pressure chambers has a substantially oval shape and a cross sectional area as viewed in a direction perpendicular to said plate-like piezoelectric actuator unit, wherein said central region of each of said active portions has a substantially oval shape and a cross sectional area as viewed in said direction perpendicular to said plate-like piezoelectric actuator unit, such that said cross sectional area of said central region is smaller than said cross sectional area of each of said plurality of pressure chambers, and wherein said outer region of each of said active portions has an annular shape as viewed in said direction perpendicular to said plate-like piezoelectric actuator unit.

21. A micro pump comprising:

liquid delivering device including (a) a cavity unit defining a plurality of pressure chambers for accommodating a liquid which is to be delivered to an exterior of said liquid delivering device, and (b) a piezoelectric actuator unit superposed on said cavity unit, and having a plurality of active portions which are opposed to the respective pressure chambers and which are selectively deformable upon application of a drive voltage thereto so as to deliver the liquid from the corresponding pressure chambers to the exterior of said liquid delivering device; and a pump adapter having an inlet port and a plurality of outlet ports, and connected to said liquid delivering device such that said inlet port is held in communication with said pressure chambers while said outlet ports are held in communication with the corresponding pressure chambers, wherein said piezoelectric actuator unit has a plate-like shape, and includes (b-1) a piezoelectric material layer which is deformable at least in a direction parallel thereto upon generation of an electric field therein as a result of the application of the drive voltage to said piezoelectric actuator unit, (b-2) a first flexible layer which is laminated on one of opposite side surfaces of said piezoelectric material layer, and (b-3) a second flexible layer which is laminated on the other of said opposite side surfaces of said piezoelectric material layer, wherein a portion of said piezoelectric material layer located in a central region of each of said active portions is offset from a center of said piezoelectric actuator unit, as viewed in a thickness direction of said piezoelectric actuator unit, in one of a direction toward said cavity unit and a direction away from said cavity unit, while a portion of said piezoelectric material layer located in an outer region of each of said active portions is offset from said center of said piezoelectric actuator unit, as viewed in said thickness direction, in the other of said direction toward said cavity unit and said direction away from said cavity unit, and wherein said inlet port of said pump adapter is to be immersed in the liquid reserved in a liquid reservoir, so that the liquid is delivered from the liquid reservoir to an exterior of said micro pump through said inlet port, said pressure chambers and said outlet ports.

* * * * *